US009740115B1

(12) United States Patent
Sano et al.

(10) Patent No.: US 9,740,115 B1
(45) Date of Patent: Aug. 22, 2017

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Tatsuki Sano, Kanagawa (JP); Hideya Katsuhara, Kanagawa (JP); Masaki Hirakata, Kanagawa (JP); Takeshi Iwanaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/202,985

(22) Filed: Jul. 6, 2016

(30) Foreign Application Priority Data

Feb. 19, 2016 (JP) ..... 2016-030321

(51) Int. Cl.

| | |
|---|---|
| ***G03G 5/147*** | (2006.01) |
| ***G03G 5/047*** | (2006.01) |
| ***G03G 15/00*** | (2006.01) |
| ***G03G 5/06*** | (2006.01) |
| ***G03G 5/05*** | (2006.01) |

(52) U.S. Cl.
CPC ..... *G03G 5/047* (2013.01); *G03G 5/0503* (2013.01); *G03G 5/0564* (2013.01); *G03G 5/0614* (2013.01); *G03G 5/0696* (2013.01); *G03G 5/14704* (2013.01); *G03G 15/75* (2013.01)

(58) Field of Classification Search
CPC ..... G03G 5/14704
See application file for complete search history.

(56) References Cited

U.S. PATENT DOCUMENTS

| | | | | |
|---|---|---|---|---|
| 4,848,141 | A | 7/1989 | Oliver et al. | |
| 5,298,617 | A | 3/1994 | Nukada et al. | |
| 5,302,479 | A | 4/1994 | Daimon et al. | |
| 5,459,004 | A | 10/1995 | Daimon et al. | |
| 2005/0266324 | A1* | 12/2005 | Kobayashi | G03G 5/14 430/58.05 |
| 2008/0070138 | A1* | 3/2008 | Yagi | G03G 5/0525 430/66 |
| 2009/0117481 | A1* | 5/2009 | Yasunaga | G03G 9/081 430/108.7 |

FOREIGN PATENT DOCUMENTS

| | | | |
|---|---|---|---|
| EP | 0710893 | A1 | 5/1996 |
| JP | H04-189873 | A | 7/1992 |
| JP | H04-240656 | A | 8/1992 |
| JP | H05-98181 | A | 4/1993 |
| JP | H05-140472 | A | 6/1993 |
| JP | H05-140473 | A | 6/1993 |
| JP | H05-263007 | A | 10/1993 |
| JP | H05-279591 | A | 10/1993 |
| JP | H08-176293 | A | 7/1996 |
| JP | H08-208820 | A | 8/1996 |
| JP | H08-254850 | A | 10/1996 |
| JP | H09-319130 | A | 12/1997 |
| JP | 2004-078147 | A | 3/2004 |
| JP | 2005-181992 | A | 7/2005 |
| JP | 2012-155282 | A | 8/2012 |

* cited by examiner

*Primary Examiner* — Hoa V Le
(74) *Attorney, Agent, or Firm* — Oliff PLC

(57) ABSTRACT

An electrophotographic photoreceptor includes a conductive substrate, an organic photosensitive layer on the conductive substrate, and an inorganic protective layer on the organic photosensitive layer. A layer that constitutes a surface of the organic photosensitive layer contains a charge transport material, a binder resin, silica particles, and a silicone compound.

9 Claims, 7 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-030321 filed Feb. 19, 2016.

BACKGROUND

Technical Field

The present invention relates to an electrophotographic photoreceptor, a process cartridge, and an image forming apparatus.

SUMMARY

According to an aspect of the invention, there is provided an electrophotographic photoreceptor that includes a conductive base, an organic photosensitive layer on the conductive base, and an inorganic protective layer on the organic photosensitive layer. A layer that constitutes a surface of the organic photosensitive layer contains a charge transport material, a binder resin, silica particles, and a silicone compound.

BRIEF DESCRIPTION OF THE DRAWINGS

Exemplary embodiments of the present invention will be described in detail based on the following figures, wherein.

DETAILED DESCRIPTION

Figure 1:
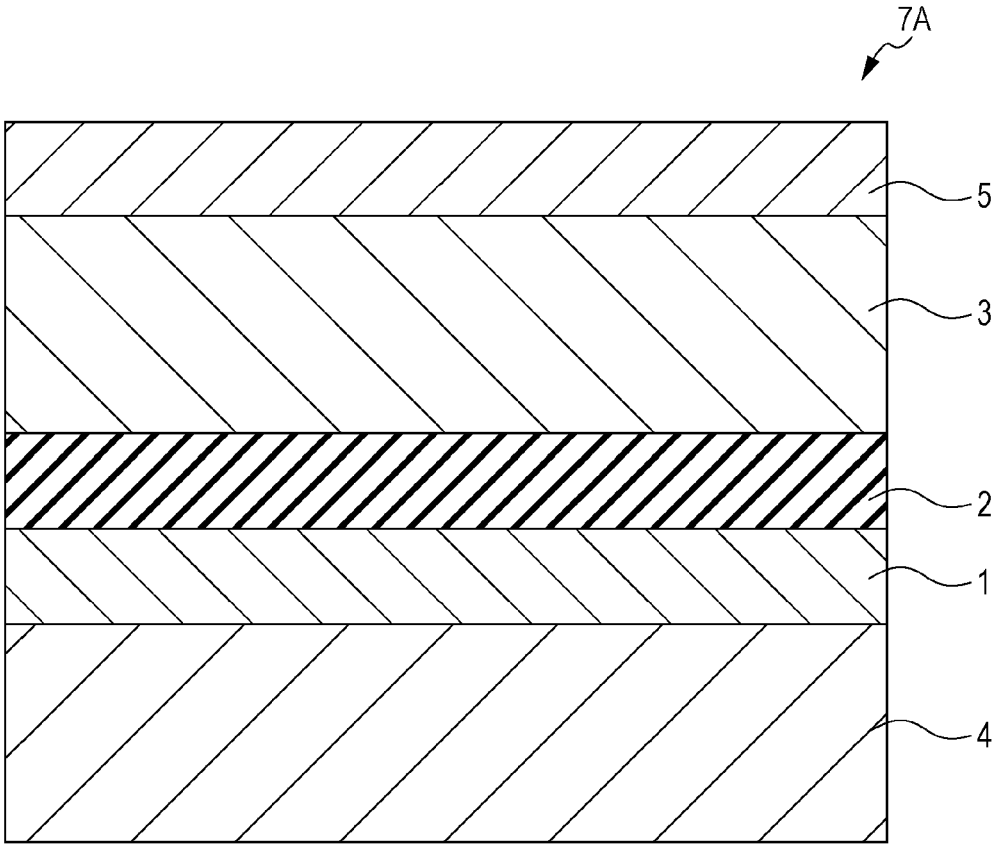
FIG. 1 is a schematic cross-sectional view illustrating an example layer configuration of an electrophotographic photoreceptor according to an exemplary embodiment.

Exemplary embodiments of the present invention will now be described in detail.

Electrophotographic Photoreceptor

An electrophotographic photoreceptor according to an exemplary embodiment includes a conductive substrate, an organic photosensitive layer on the conductive substrate, and an inorganic protective layer on the organic photosensitive layer.

A layer that constitutes a surface of the organic photosensitive layer contains a charge transport material, a binder resin, silica particles, and a silicone compound.

Specifically, when the organic photosensitive layer is a single-layer organic photosensitive layer, the organic photosensitive layer contains a charge generation material, a charge transport material, a binder resin, silica particles, and a silicone compound.

In contrast, when the organic photosensitive layer is a separated-function-type organic photosensitive layer, the organic photosensitive layer may be an organic photosensitive layer that includes a charge generation and a charge transport layer that are stacked on the conductive substrate in this order. The charge transport layer contains a charge transport material, a binder resin, silica particles, and a silicone compound. When the charge transport layer includes two or more layers, the layer that constitutes the surface of the charge transport layer (i.e., the uppermost layer of the charge transport layer) contains a charge transport material, a binder resin, silica particles, and a silicone compound.

A technique of forming an inorganic protective layer on an organic photosensitive layer is known in the related art. However, while an organic photosensitive layer has flexibility and a tendency to deform, an inorganic protective layer is hard and tends to have poor toughness. When the organic photosensitive layer, which lies under the inorganic protective layer, deforms, the inorganic protective layer may crack. Since the electrophotographic photoreceptor is often put under a mechanical load from components (e.g., an intermediate transfer body) arranged to be in contact with the surface of the electrophotographic photoreceptor, this phenomenon occurs easily.

To address this issue, the layer that constitutes the surface of the organic photosensitive layer is designed to contain a charge transport material, a binder resin, and silica particles so that the silica particles serve as a reinforcing material for the organic photosensitive layer. This presumably decreases deformation of the organic photosensitive layer and suppresses cracking of the inorganic protective layer.

Incorporation of silica particles in the organic photosensitive layer improves the elastic modulus of the organic photosensitive layer. However, when dispersibility of the silica particles is degraded, the elastic modulus of the organic photosensitive layer may vary. When the elastic modulus of the organic photosensitive layer containing silica particles varies, the organic photosensitive layer comes to have portions where the elastic modulus is high and portions where the elastic modulus is low. It has been found that portions of the inorganic protective layer that are on the portions of the organic photosensitive layer where the elastic modulus is low are more susceptible to cracking (including denting).

Degradation of dispersibility of silica particles in the organic photosensitive layer is presumably attributable to low affinity between the binder resin and the silica particles in the organic photosensitive layer. For example, silica particles tend to have improved dispersibility in the organic photosensitive layer when hydrophobized; however, even when hydrophobized silica particles are used (for example, when the condensation ratio is 96% or more), degradation of dispersibility may occur.

In contrast, according to the electrophotographic photoreceptor of this exemplary embodiment, a silicone compound is used in combination with silica particles in the layer that constitutes a surface of the organic photosensitive layer. As a result, variation in elastic modulus of the organic photosensitive layer is decreased, the elastic modulus of the organic photosensitive layer as a whole is improved, and cracking of the inorganic protective layer is suppressed.

The reason for this is not clear but can be presumed as follows. Silica particles and silicone compounds both contain silicon in their chemical structures and thus have high affinity to each other. A silicone compound has many hydrophobic groups (for example, methyl) in its chemical structure and thus has high affinity to binder resins. Thus, when a silicone compound is used in combination with silica particles, the silicone compound tends to come between the silica particles and the binder resin and increase the affinity between the binder resin and the silica particles. In other words, due to the interaction between the silica particles and the silicone compound, degradation of dispersibility of silica particles in the organic photosensitive layer is easily suppressed.

As a result, variation in elastic modulus of the organic photosensitive layer is decreased. The decreased variation in elastic modulus of the organic photosensitive layer improves the elastic modulus of the organic photosensitive layer as a whole. Presumably as a result, according to the electrophotographic photoreceptor of this exemplary embodiment, cracking of the inorganic protective layer is suppressed.

In sum, according to the electrophotographic photoreceptor of this exemplary embodiment, cracking of the inorganic protective layer is suppressed by the features described above.

If the dispersibility of the silica particles is degraded when the silica particles are added to the organic photosensitive layer, the surface roughness of the organic photosensitive layer tends to increase and, as a result, the surface roughness of the inorganic protective layer tends to increase. Then the cleaning property of the surface of the photoreceptor tends to be degraded.

In contrast, according to the electrophotographic photoreceptor of this exemplary embodiment, dispersibility of the silica particles is improved by the features described above and thus the surface roughness of the organic photosensitive layer tends to decrease. Since the surface roughness of the inorganic protective layer tends to decrease also, degradation of the cleaning property of the surface of the photoreceptor is suppressed.

The electrophotographic photoreceptor according to this exemplary embodiment will now be described in detail with reference to the drawings. In the drawings, the same or equivalent portions are represented by the same reference symbols and the descriptions therefor are omitted to avoid redundancy.

Figure 2:
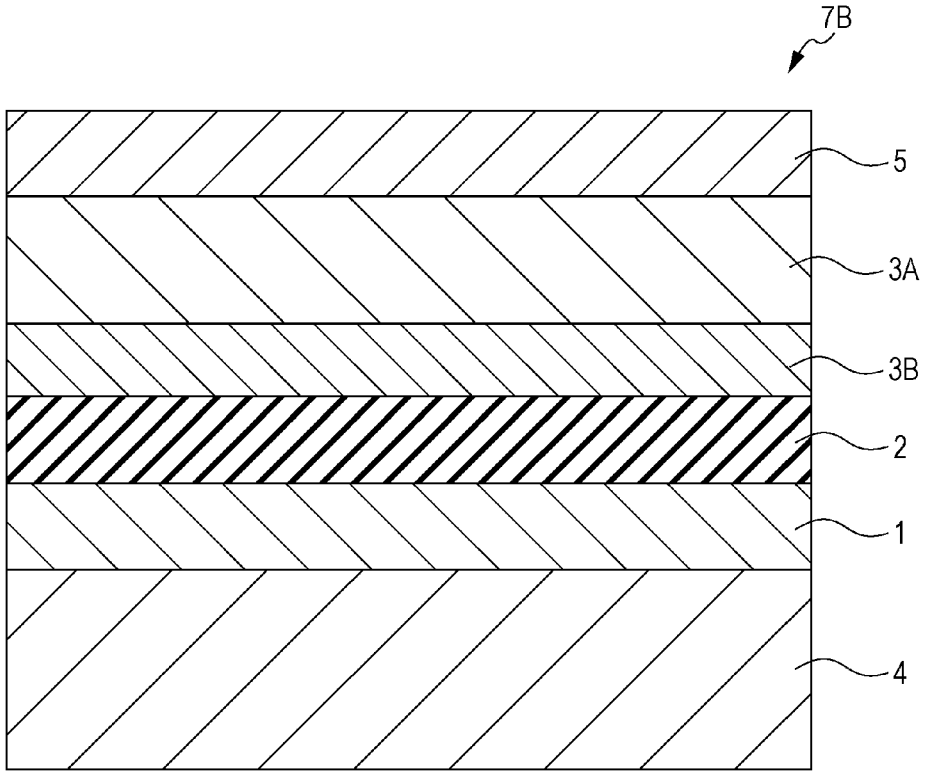
FIG. 2 is a schematic cross-sectional view illustrating another example layer configuration of the electrophotographic photoreceptor according to the exemplary embodiment.
Figure 3:
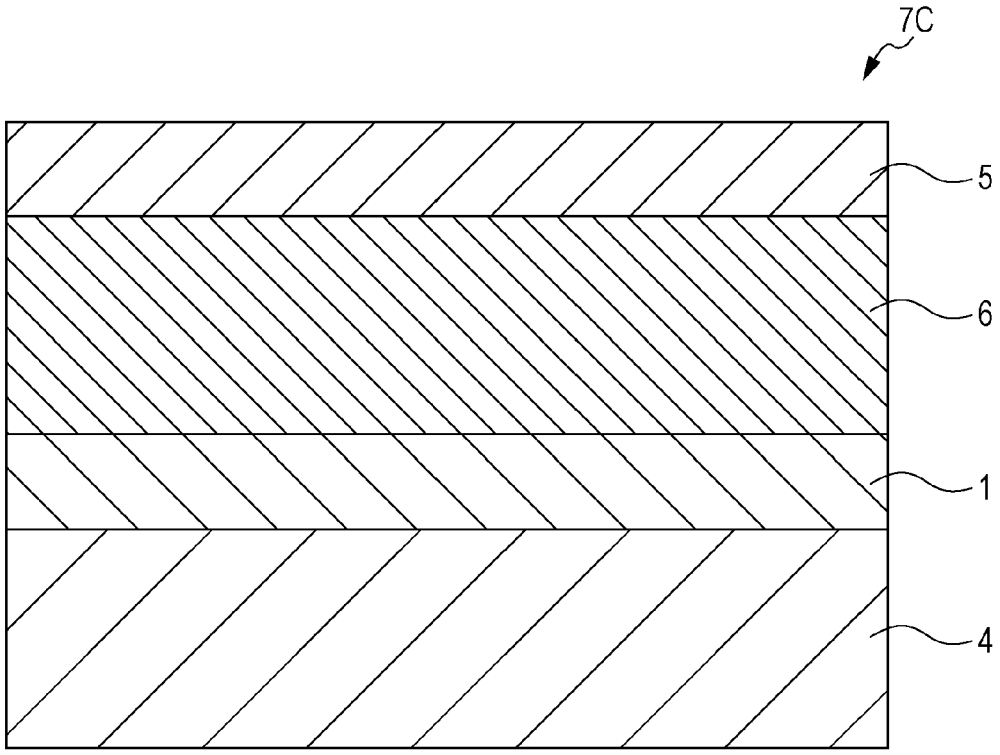
FIG. 3 is a schematic cross-sectional view illustrating yet another example layer configuration of the electrophotographic photoreceptor according to the exemplary embodiment.

FIG. 1 is a schematic cross-sectional view of an example of the electrophotographic photoreceptor according to this exemplary embodiment. FIGS. 2 and 3 are schematic cross-sectional views respectively illustrating other examples of the electrophotographic photoreceptor of the exemplary embodiment.

An electrophotographic photoreceptor 7A illustrated in FIG. 1 is what is known as a separated-function-type photoreceptor (or a multilayer photoreceptor) having a structure in which an undercoat layer 1 is disposed on a conductive substrate 4, and a charge generation layer 2, a charge transport layer 3, and an inorganic protective layer 5 are sequentially stacked on the undercoat layer 1. In the electrophotographic photoreceptor 7A, the charge generation layer 2 and the charge transport layer 3 constitute an organic photosensitive layer. The charge transport layer 3 contains a charge transport material, a binder resin, silica particles, and a silicone compound.

An electrophotographic photoreceptor 7B illustrated in FIG. 2 is also a separated-function-type photoreceptor having a structure in which the functions are divided between the charge generation layer 2 and the charge transport layer 3 as in the electrophotographic photoreceptor 7A illustrated in FIG. 1, and the charge transport layer 3 is also of a separated function type. An electrophotographic photoreceptor 7C illustrated in FIG. 3 contains a charge generation material and a charge transport material in the same layer (single-layer-type organic photosensitive layer 6 (charge generation/charge transport layer)).

In the electrophotographic photoreceptor 7B illustrated in FIG. 2, an undercoat layer 1 is disposed on a conductive substrate 4, and a charge generation layer 2, a charge transport layer 3B, a charge transport layer 3A, and an inorganic protective layer 5 are sequentially stacked on the undercoat layer 1. In the electrophotographic photoreceptor 7B, the charge transport layer 3A, the charge transport layer 3B, and the charge generation layer 2 constitute an organic photosensitive layer. The charge transport layer 3A contains a charge transport material, a binder resin, silica particles, and a silicone compound. The charge transport layer 3B is configured to contain at least a charge transport material, and may contain silica particles and a silicone compound.

The electrophotographic photoreceptor 7C illustrated in FIG. 3 has a structure in which an undercoat layer 1 is disposed on a conductive substrate 4 and a single-layer-type organic photosensitive layer 6 and an inorganic protective layer 5 are sequentially stacked on the undercoat layer 1. The single-layer-type organic photosensitive layer 6 is configured to contain a charge transport material, a binder resin, silica particles, and a silicone compound.

In the electrophotographic photoreceptors illustrated in FIGS. 1 to 3, the undercoat layer 1 is optional.

Individual components of the electrophotographic photoreceptor 7A illustrated in FIG. 1 as a representative example are described below. The reference numerals are sometimes omitted in the description.

Conductive Substrate

Examples of the conductive substrate include metal plates, metal drums, and metal belts that contain metals (aluminum, copper, zinc, chromium, nickel, molybdenum, vanadium, indium, gold, platinum, etc.) or alloys (stainless steels etc.). Other examples of the conductive substrate include paper, resin films, and belts onto which conductive compounds (for example, conductive polymers and indium oxide), metals (for example, aluminum, palladium, and gold), or alloys are applied, vapor-deposited, or laminated. The term "conductive" means that the volume resistivity is less than $10^{13}$ Ωcm.

When the electrophotographic photoreceptor is used in a laser printer, the surface of the conductive substrate may be roughened so that the center-line average roughness Ra is 0.04 μm or more and 0.5 μm or less. This is to decrease interference fringes that occur during irradiation with a laser beam. When incoherent light is used as a light source, the surface roughening for preventing interference fringes is optional. However, surface roughening decreases occurrence of defects caused by irregularities on the surface of the conductive substrate and extends the service life.

Examples of the surface roughening technique include wet honing that involves spraying a suspension of an abrasive in water onto a conductive substrate, centerless grinding that involves pressing a conductive substrate against a rotating grinding stone to continuously perform grinding, and anodization.

Another example of the surface roughening technique does not involve directly roughening a surface of a conductive substrate; instead, the technique involves forming a layer on the surface of the conductive substrate by using a dispersion containing dispersed conductive or semi-conductive powder in a resin so that the rough surface is created by the particles dispersed in that layer.

The surface roughening by anodization involves anodizing a metal (for example, aluminum) conductive substrate serving as an anode in an electrolyte solution so as to form an oxide film on the surface of the conductive substrate. Examples of the electrolyte solution include a sulfuric acid solution and an oxalic acid solution. However, a porous anodic oxide film as is formed by anodization is chemically active and susceptible to contamination and undergoes large changes in resistance depending on the environment. Thus, the porous anodic oxide film may be subjected to a pore sealing treatment in which the fine pores of the oxide film are stopped by volume expansion caused by hydration reaction in pressurized water vapor or in boiling water (a metal salt such as a nickel salt may be added) so that the oxide is transformed into a more stable hydrous oxide.

The thickness of the anodic oxide film may be, for example, 0.3 μm or more and 15 μm or less. When the thickness is within this range, a barrier property tends to be exhibited against injection and the increase in residual potential caused by repeated use tends to be suppressed.

The conductive substrate may be treated with an acidic treatment solution or be subjected to a Boehmite treatment.

The treatment with an acidic treatment solution may be carried out as follows, for example. First, an acidic treatment solution containing phosphoric acid, chromic acid, and hydrofluoric acid is prepared. The blend ratios of the phosphoric acid, chromic acid, and hydrofluoric acid in the acidic treatment solution are, for example, phosphoric acid: 10% by weight or more and 11% by weight or less, chromic acid: 3% by weight or more and 5% by weight or less, hydrofluoric acid: 0.5% by weight or more and 2% by weight or less. The total concentration of all the acids may be in the range of 13.5% by weight or more and 18% by weight or less. The treatment temperature may be, for example, 42° C. or higher and 48° C. or lower. The thickness of the film may be 0.3 μm or more and 15 μm or less.

The Boehmite treatment is carried out by immersing the substrate in pure water at 90° C. or higher and 100° C. or lower for 5 to 60 minutes or by bringing the substrate in contact with heated water vapor at 90° C. or higher and 120° C. or lower for 5 to 60 minutes, for example. The thickness of the film may be 0.1 μm or more and 5 μm or less. The treated substrate may be further subjected to an anodization treatment by using an electrolyte solution having a low film-dissolving property. Examples of the electrolyte here include adipic acid, boric acid, a borate, a phosphate, a phthalate, a maleate, a benzoate, a tartrate, and a citrate.

Undercoat Layer

The undercoat layer is, for example, a layer that contains inorganic particles and a binder resin.

Examples of the inorganic particles include those having powder resistance (volume resistivity) of $10^2$ Ωcm or more and $10^{11}$ Ωcm or less. Examples of the inorganic particles having such a resistivity include metal oxide particles such as tin oxide particles, titanium oxide particles, zinc oxide particles, and zirconium oxide particles. In particular, zinc oxide particles may be used.

The BET specific surface area of the inorganic particles measured may be, for example, 10 $m^2/g$ or more. The volume-average particle diameter of the inorganic particles may be, for example, 50 nm or more and 2000 nm or less (or may be 60 nm or more and 1000 nm or less).

The amount of the inorganic particles relative to the binder resin is, for example, 10% by weight or more and 80% by weight or less, and may be 40% by weight or more and 80% by weight or less.

The inorganic particles may be surface-treated. Two or more types of inorganic particles subjected to different surface treatments or having different particle diameters may be mixed and used.

Examples of the surface treatment agent include silane coupling agents, titanate coupling agents, aluminum coupling agents, and surfactants. The surface treatment agent may be a silane coupling agent, specifically, an amino-group-containing silane coupling agent.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used as a mixture. For example, an amino-group-containing silane coupling agent and another silane coupling agent may be used in combination. Examples of this another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using a surface treatment agent may be any known method and may be a dry or wet method.

The amount of the surface treatment agent used in the treatment may be 0.5% by weight or more and 10% by weight or less relative to the inorganic particles.

The undercoat layer may contain inorganic particles and an electron-accepting compound (acceptor compound) from the viewpoints of enhancing long-term stability of electrical characteristics and a carrier blocking property.

Examples of the electron-accepting compound include electron transport substances. Examples thereof include quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

A compound having an anthraquinone structure may be used as the electron-accepting compound. Examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer by being co-dispersed with the inorganic particles or by being attached to the surfaces of the inorganic particles.

Examples of the method for attaching the electron-accepting compound onto the surfaces of the inorganic particles include a wet method or a dry method.

According to a dry method, for example, while inorganic particles are being stirred with a mixer having large shear force, an electron-accepting compound as is or as dissolved in an organic solvent is added thereto dropwise or sprayed along with dry air or nitrogen gas so that the electron-accepting compound attaches to the surfaces of the inorganic particles. Dropwise addition or spraying of the electron-accepting compound may be performed at a temperature not higher than the boiling point of the solvent. After dropwise addition or spraying of the electron-accepting compound, baking may be conducted at 100° C. or higher. Baking may be performed at any temperature for any length of time as long as electrophotographic properties are obtained.

According to a wet method, for example, while inorganic particles are being dispersed in a solvent by stirring or by using ultrasonic waves, a sand mill, an attritor, a ball mill, or the like, an electron-accepting compound is added thereto, and after stirring or dispersing, the solvent is removed to have the electron-accepting compound attach to the surfaces of the inorganic particles. Examples of the method for removing the solvent include filtration and distillation. Baking at 100° C. or higher may be conducted after the removal of the solvent. Baking may be performed at any temperature for any length of time as long as electrophotographic properties are obtained. In the wet method, water contained in the inorganic particles may be removed prior to adding the electron-accepting compound. For example, the inorganic particles may be stirred and heated in a solvent to remove water or water may be azeotropically removed with a solvent.

Attaching the electron-accepting compound may be performed before, after, or simultaneously with performing the surface treatment on the inorganic particles by using a surface treatment agent.

The amount of the electron-accepting compound relative to the inorganic particles is, for example, 0.01% by weight or more and 20% by weight or less and may be 0.01% by weight or more and 10% by weight or less.

Examples of the binder resin used in the undercoat layer include known polymer materials such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; and other known materials such as zirconium chelate compounds, titanium chelate compounds, aluminum chelate compounds, titanium alkoxide compounds, organic titanium compounds, and silane coupling agents. Other examples of the binder resin used in the undercoat layer include charge transport resins having charge transport groups and conductive resins (for example, polyaniline).

Among these, a resin insoluble in the coating solvent contained in the overlying layer may be used as the binder resin contained in the undercoat layer. Examples thereof include thermosetting resins such as urea resins, phenolic resins, phenol-formaldehyde resins, melamine resins, urethane resins, unsaturated polyester resins, alkyd resins, and epoxy resins; and resins obtained by reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin. When two or more of these binder resins are used in combination, the mixing ratio is set as desired.

The undercoat layer may contain various additives that improve electrical properties, environmental stability and image quality. Examples of the additives include known materials such as electron transport pigments based on condensed polycyclic and azo materials, zirconium chelate compounds, titanium chelate compounds, aluminum chelate compounds, titanium alkoxide compounds, organic titanium compounds, and silane coupling agents. Although a silane coupling agent is used in a surface treatment of inorganic particles as discussed above, it may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethyl acetoacetate).

These additives may be used alone, as a mixture of two or more compounds, or as a polycondensation product of two or more compounds.

The undercoat layer may have a Vickers hardness of 35 or more. In order to suppress Moire-images, the surface roughness (ten point average roughness) of the undercoat layer may be adjusted to be in the range of 1/(4n) (n: refractive index of overlying layer) to ½ of the wavelength λ of the laser used for exposure.

Resin particles and the like may be added to the undercoat layer to adjust the surface roughness. Examples of the resin particles include silicone resin particles, and crosslinked polymethyl methacrylate resin particles. The surface of the undercoat layer may be polished to adjust the surface roughness. Examples of the polishing technique include buff polishing, sand blasting, wet honing, and grinding.

The undercoat layer may be formed by any known method. For example, a coating solution for forming an undercoat layer may be prepared by adding the above-described components to a solvent and applied to form a coating film, and the coating film may be dried, and if desirable, heated.

A known organic solvent may be used as the solvent for preparing the coating solution for forming the undercoat layer. Examples of the known organic solvent include alcohol solvents, aromatic hydrocarbon solvents, halogenated hydrocarbon solvents, ketone solvents, ketone alcohol solvents, ether solvents, and ester solvents.

Specific examples of these solvents include common organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the technique for dispersing inorganic particles in preparing the coating solution for forming the undercoat layer include known techniques that use a roll mill, a ball mill, a vibrating ball mill, an attritor, a sand mill, a colloid mill, and a paint shaker.

Examples of the technique for applying the coating solution for forming the undercoat layer onto the conductive substrate include known techniques such as a blade coating technique, a wire bar coating technique, a spray coating technique, a dip coating technique, a bead coating technique, an air knife coating technique, and a curtain coating technique.

The thickness of the undercoat layer is, for example, 15 μm or more and may be in the range of 20 μm or more and 50 μm or less.

Intermediate Layer

An intermediate layer may be further provided between the undercoat layer and the photosensitive layer although this is not illustrated in the drawings. The intermediate layer is, for example, a layer containing a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound used in the intermediate layer include those which contain metal atoms such as zirconium, titanium, aluminum, manganese, and silicon atoms. The compounds used in the intermediate layer may be used alone, as a mixture of two or more compounds, or as a polycondensation product of two or more compounds.

In particular, the intermediate layer may be a layer that contains an organic metal compound that contains a zirconium atom or a silicon atom.

The intermediate layer may be formed by any known method. For example, a coating solution for forming the intermediate layer may be prepared by adding the above-described components to a solvent and applied to form a coating film, and the coating film may be dried and, if desired, heated. Examples of the technique for applying the solution for forming the intermediate layer include known techniques such as a dip coating technique, a lift coating technique, a wire bar coating technique, a spray coating technique, a blade coating technique, a knife coating technique, and a curtain coating technique.

The thickness of the intermediate layer may be set within the range of 0.1 μm or more and 3 μm or less. The intermediate layer may also serve as an undercoat layer.

Charge Generation Layer

The charge generation layer is a layer that contains a charge generation material and a binder resin. The charge generation layer may be a layer formed by vapor deposition of a charge generation material. The vapor deposited layer of the charge generation material is suitable when an incoherent light source such as a light-emitting diode (LED) or an organic electro-luminescence (EL) image array is used as the light source.

Examples of the charge generation material include azo pigments such as bisazo and trisazo pigments; condensed aromatic pigments such as dibromoanthanthrone; perylene pigments; pyrrolopyrrole pigments; phthalocyanine pigments; zinc oxide; and trigonal selenium.

Among these, a metal phthalocyanine pigment or a metal-free phthalocyanine pigment may be used as the charge generation material in order to allow use of near infrared laser exposure. Specific examples thereof include hydroxygallium phthalocyanine disclosed in Japanese Unexamined Patent Application Publication Nos. 5-263007 and 5-279591; chlorogallium phthalocyanine disclosed in Japanese Unexamined Patent Application Publication No. 5-98181; dichlorotin phthalocyanine disclosed in Japanese Unexamined Patent Application Publication Nos. 5-140472 and 5-140473; and titanyl phthalocyanine disclosed in Japanese Unexamined Patent Application Publication No. 4-189873.

In order to allow use of near-ultraviolet laser exposure, the charge generation material may be a condensed aromatic pigment such as dibromoanthanthrone, a thioindigo pigment, a porphyrazine compound, zinc oxide, trigonal selenium, or a bisazo pigment disclosed in Japanese Unexamined Patent Application Publication Nos. 2004-78147 and 2005-181992, for example.

The above-described charge generation material may be used in the case where an incoherent light source, such as an LED or organic EL image array, having an emission center wavelength in the range of 450 nm or more and 780 nm or less is used. However, when the photosensitive layer is as thin as 20 μm or less to improve resolution, the field strength in the photosensitive layer increases and electrification resulting from charge injection from the substrate decreases, thereby readily generating image defects known as black spots. This phenomenon is notable when a charge generation material, such as trigonal selenium or a phthalocyanine pigment, that is a p-type semiconductor and readily generates dark current is used.

In contrast, when an n-type semiconductor such as a condensed aromatic pigment, a perylene pigment, or an azo pigment is used as the charge generation material, dark current rarely occurs and fewer image defects called black spots occur despite a small thickness. Examples of the n-type charge generation material include, but are not limited to, compounds (CG-1) to (CG-27) described in paragraphs 0288 to 0291 in Japanese Unexamined Patent Application Publication No. 2012-155282. Whether the semiconductor is n-type or not is determined by a typical time-of-flight technique in which the polarity of photoelectric current flowing therein is determined and a compound that allows electrons rather than holes to flow as a carrier is determined to be the n-type.

The binder resin used in the charge generation layer is selected from a wide variety of insulating resins. The binder resin may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (polycondensation products of bisphenols and aromatic divalent carboxylic acids, etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is $10^{13}$ Ωcm or more. These binder resins may be used alone or as a mixture or two or more.

The blend ratio of the charge generation material to the binder resin may be within the range of 10:1 to 1:10 on a weight basis.

The charge generation layer may contain other known additives.

The charge generation layer may be formed by any known method. For example, a coating solution for forming a charge generation layer may be prepared by adding the above-described components to a solvent and applied to form a coating film, and the coating film may be dried and, if desired, heated. The charge generation layer may also be formed by vapor deposition of a charge generation material. Formation of the charge generation layer by vapor deposition may be employed when a condensed aromatic pigment or a perylene pigment is used as the charge generation material.

Examples of the solvent for preparing the coating solution for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more.

The technique for dispersing particles (for example, a charge generation material) in the coating solution for forming a charge generation layer includes those which use a medium disperser such as a ball mill, a vibrating ball mill, an attritor, a sand mill, or a horizontal sand mill, and a medium-less disperser such as an agitator, an ultrasonic disperser, a roll mill, and a high-pressure homogenizer. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure. In conducting dispersion, it is effective to control the average particle diameter of the charge generation material in the coating solution for forming a charge generation layer to 0.5 μm or less, 0.3 μm or less in some cases, or 0.15 μm or less in some cases.

Examples of the technique of applying the coating solution for forming a charge generation layer onto the undercoat layer (or intermediate layer) include typical techniques such as a blade coating technique, a wire bar coating technique, a spray coating technique, a dip coating technique, a bead coating technique, an air knife coating technique, and a curtain coating technique.

The thickness of the charge generation layer may be, for example, 0.1 μm or more and 5.0 μm or less in some cases and may be 0.2 μm or more and 2.0 μm or less in some cases.

Charge Transport Layer

Composition of Charge Transport Layer

The charge transport layer contains a charge transport material, a binder resin, silica particles, and a silicone compound.

Examples of the charge transport material include quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Examples of hole transport compounds that may be used as the charge transport material include triarylamine compounds, benzidine compounds, aryl alkane compounds, aryl-substituted ethylene compounds, stilbene compounds, anthracene compounds, and hydrazone compounds. These charge transport materials are non-limiting examples and may be used alone or in combination.

From the viewpoint of charge mobility, the charge transport material may be a triarylamine derivative represented by structural formula (a-1) below or a benzidine derivative represented by structural formula (a-2) below.

(a-1)

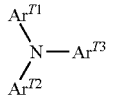

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent for the groups described above.

(a-2)

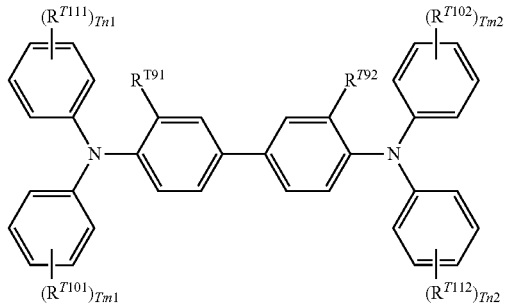

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, —C($R^{T12}$)=C($R^{T13}$)($R^{T14}$), or —CH=CH—CH=C($R^{T15}$)($R^{T16}$). $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. $Tm_1$, $Tm_2$, $Tn_1$, and $Tn_2$ each independently represent an integer of 0 or more and 2 or less.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent of the group.

Among the triarylamine derivatives represented by structural formula (a-1) and benzidine derivatives represented by structural formula (a-2), triarylamine derivatives having "—$C_6H_4$—CH=CH—CH=C($R^{T7}$)($R^{T8}$)" and benzidine derivatives having "—CH=CH—CH=C($R^{T15}$)($R^{T16}$)" are preferable from the viewpoint of charge mobility.

Charge transport materials that are commonly available such as poly-N-vinyl carbazole and polysilane are used as the polymer charge transport material. Specifically, polyester charge transport materials disclosed in Japanese Unexamined Patent Application Publication Nos. 8-176293 and 8-208820 may be used. The polymer charge transport material may be used alone or in combination with a binder resin.

Examples of the silica particles used in the charge transport layer include silica particles formed by dry process and silica particles formed by wet process. Examples of the silica particles formed by dry process include pyrogenic silica (fumed silica) obtained by burning silane compounds and deflagration silica obtained by deflagrating metal silicon powder. Examples of the silica particles formed by wet process include wet silica particles obtained by neutralization reaction between sodium silicate and mineral acid (precipitated silica synthesized and aggregated under alkaline conditions and gel silica particles synthesized and aggregated under acidic conditions), colloidal silica particles obtained by alkalinizing and polymerizing acidic silicates (silica sol particles), and sol-gel silica particles obtained by hydrolysis of organic silane compounds (for example, alkoxy silane).

Among these, pyrogenic silica particles having fewer silanol groups at the surface and a low-porosity structure are preferable from the viewpoint of suppressing image defects (suppressing degradation of thin line reproducibility) caused by generation of residual potential and other degradation of electrical properties.

The volume-average particle diameter of the silica particles is preferably 20 nm or more and 200 nm or less, more preferably 40 nm or more and 150 nm or less, yet more preferably 50 nm or more and 120 nm or less, and most preferably 50 nm or more and 110 nm or less.

When silica particles having a volume-average particle diameter within the above-described range are used in combination with a binder resin having a viscosity-average molecular weight less than 50,000, the surface roughness of the charge transport layer is more easily decreased and occurrence of image deletion is more easily suppressed.

The volume-average particle diameter of the silica particles is measured by separating silica particles from the layer, observing 100 primary particles of the silica particles with a scanning electron microscope (SEM) at a magnification of 40,000, measuring the longest axis and the shortest axis of each particle by image analysis of the primary particles, determining the equivalent sphere diameter from the intermediate value, determining a 50% diameter (D50v) from the cumulative frequency of the obtained equivalent sphere diameters, and assuming the result to be the volume-average particle diameter of the silica particles.

The silica particles may be surface-treated with a hydrophobizing agent. The surface treatment decreases the number of silanol groups on the surfaces of the silica particles and tends to suppress generation of residual potential. Examples of the hydrophobizing agent include common silane compounds such as chlorosilane, alkoxysilane, and silazane. Among these, a silane compound having a trimethylsilyl group, a decylsilyl group, or a phenylsilyl group is preferable from the viewpoint of ease of suppressing generation of residual potential. In other words, the surfaces of the silica particles may have trimethylsilyl groups, decylsilyl groups, or phenylsilyl groups.

Examples of the silane compound having a trimethylsilyl group include trimethylchlorosilane, trimethylmethoxysilane, and 1,1,1,3,3,3-hexamethyldisilazane. Examples of the silane compound having a decylsilyl group include decyltrichlorosilane, decyldimethylchlorosilane, and decyltrimethoxysilane. Examples of the silane compound having a phenylsilyl group include triphenylmethoxysilane and triphenylchlorosilane.

The condensation ratio of the hydrophobized silica particles (the ratio of Si—O—Si in $SiO_4$— bonds in the silica particles, hereinafter, this ratio may be referred to as a "hydrophobizing agent condensation ratio") is, for example, 96% or more or about 96% or more, preferably 97% or more, and more preferably 98% or more relative to the silanol groups on the surfaces of the silica particles. When the hydrophobizing agent condensation ratio is within the above-described range, the number of silanol groups on the silica particles is decreased and generation of residual potential is more easily suppressed.

The hydrophobizing agent condensation ratio indicates the ratio of condensed silicon atoms to all sites capable of bonding to silicon atoms in the condensed portions detected by NMR and is measured as follows.

First, silica particles are separated from the layer. The separated silica particles are subjected to Si CP/MAS NMR analysis with AVANCE III 400 produced by Bruker to determine the peak areas according to the number of substituted SiO. The values for disubstituted ($Si(OH)_2(O—Si)_2$—), trisubstituted ($Si(OH)(O—Si)_3$—), and tetrasubstituted ($Si(O—Si)_4$—) segments are respectively assumed to be Q2, Q3, and Q4. The hydrophobizing agent condensation ratio is given by formula $(Q2\times2+Q3\times3+Q4\times4)/4\times(Q2+Q3+Q4)$.

The volume resistivity of the silica particles is, for example, $10^{11}$ Ω·cm or more, preferably $10^{12}$ Ω·cm or more, and more preferably $10^{13}$ Ω·cm or more. When the volume resistivity of the silica particles is within the above-described range, degradation of electrical properties is suppressed.

The volume resistivity of the silica particles is measured as follows. The measurement environment is a temperature of 20° C. and a humidity of 50% RH.

First, silica particles are separated from the layer. The separated silica particles, which are the measurement object, are placed on a surface of a circular jig equipped with a 20 $cm^2$ electrode plate in such a manner that the thickness of a layer formed by the silica particles is about 1 mm or more and about 3 mm or less. An identical 20 $cm^2$ electrode plate is placed on the silica particle layer so as to sandwich the silica particle layers with the electrode plates. In order to eliminate voids between the silica particles, a load of 4 kg is applied to the electrode plate placed on the silica particle layer and then the thickness (cm) of the silica particle layer is measured. The two electrode plates sandwiching the silica particle layer are connected to an electrometer and a high-voltage power generator. A high voltage is applied to the two electrodes so that a predetermined electric field is created and the value (A) of the current flowing at that time is measured to calculate the volume resistivity (Ω·cm) of the silica particles. The calculation formula for the volume resistivity (Ω·cm) of the silica particles is as follows:

$$\rho=E\times 20/(I-I_0)/L$$

where ρ represents a volume resistivity (Ω·cm) of the silica particles, E represents an applied voltage (V), I represents a current value (A), $I_0$ represents a current value (A) at an applied voltage of 0 V, and L represents a thickness (cm) of the silica particle layer. In evaluation, the volume resistivity at an applied voltage of 1,000 V is used.

The amount of the silica particles relative to the entire charge transport layer may be 30% by weight or more or about 30% by weight or more, may be 40% by weight or more, or may be 50% by weight or more in order to suppress cracking of the inorganic protective layer. The upper limit is not particularly limited and may be 70% by weight or less or about 70% by weight, preferably 65% by weight or less, and more preferably 60% by weight or less in order for the charge transport layer to have charge transport properties.

Examples of the silicone compound used in the charge transport layer include compounds having siloxane skeletons. In order to suppress cracking of the inorganic protective layer, a silicone oil (straight silicone oil or modified silicone oil) may be used. The silicone oil may have low reactivity.

Specific examples of the silicone compound include straight silicone oils such as dimethylsilicone oil, methylphenylsilicone oil, and diphenylsilicone oil, and modified silicone oils such as phenyl-modified silicone oils, aralkyl-modified silicone oils, alkyl-modified silicone oils, fluoro-modified silicone oils, fluoroalkyl-modified silicone oils, polyether-modified silicone oils, polyol-modified silicone oils, polyester-modified silicone oils, aliphatic acid ester-modified silicone oils, and acryl-modified silicone oils.

The amount of the silicone compound relative to the solid content of the layer constituting the surface of the organic photosensitive layer may be 0.0033% by weight or more and 0.033% by weight or less, may be about 0.0033% by weight or more and about 0.033% by weight or less, or may be 0.0066% by weight or more and 0.02% by weight or less in some cases. When the amount of silicone compound is within this range, the dispersibility of the silica particles is easily improved. Moreover, the surface roughness Ra of the charge transport layer can be easily controlled to a low level.

The amount of the silicone compound contained in the charge transport layer is measured as follows. First, the inorganic protective layer is stripped away from the photoreceptor to be measured, a photosensitive layer to be measured is exposed, and a part of the photosensitive layer is scraped to prepare a measurement sample. The measurement sample is subjected to nuclear magnetic resonance (NMR) analysis or the like to determine the amount of the silicone compound.

The binder resin used in the charge transport layer is not particularly limited. From the viewpoints of promoting the surface roughness of the charge transport layer to decrease and promoting suppression of cracking of the inorganic protective layer, the binder resin may have a viscosity-average molecular weight of 50,000 or less, 45,000 or less in some cases, or 35,000 or less in some cases. The lower limit of the viscosity-average molecular weight may be 20000 or more in order for the binder resin to maintain the binder properties.

The viscosity-average molecular weight of the binder resin is measured by the following single-point determination method. First, the inorganic protective layer is removed from the photoreceptor which is the measurement object. Then a photosensitive layer to be measured is exposed. A part of the photosensitive layer is scraped to prepare a measurement sample.

Then the binder resin is extracted from the measurement sample. In 100 $cm^3$ of methylene chloride, 1 g of the extracted binder resin is dissolved, and a specific viscosity ηsp of the resulting product is measured with a Ubbelohde viscometer in a measurement environment of 25° C. Then an intrinsic viscosity [η] ($cm^3/g$) is determined from the formula $\eta sp/c=[\eta]+0.45[\eta]^2c$ (where c represents a concentration ($g/cm^3$)), and the viscosity-average molecular weight Mv is determined from the formula $[\eta]=1.23\times10^{-4}\ Mv^{0.83}$ given by H. Schnell.

Specific examples of the binder resin include polycarbonate resins (homopolymeric resins such as bisphenol A, bisphenol Z, bisphenol C, and bisphenol TP, and copolymer resins thereof), polyarylate resins, polyester resins, methacrylic resins, acrylic resins, polyvinyl chloride resins, polyvinylidene chloride resins, polystyrene resins, acrylonitrile-styrene copolymers, acrylonitrile-butadiene copolymers, polyvinyl acetate resins, styrene-butadiene copolymers, vinyl chloride-vinyl acetate copolymers, vinyl chloride-vinyl acetate-maleic anhydride copolymers, silicone resins, silicone-alkyd resins, phenol-formaldehyde resins, styrene-acryl copolymers, styrene-alkyd resins, poly-N-vinylcarbazole resins, polyvinyl butyral resins, and polyphenylene ether resins. These binder resins are used alone or in combination of two or more. The blend ratio of the charge transport material to the binder resin may be in the range of 10:1 to 1:5 on a weight basis.

In order to more easily decrease the surface roughness of the charge transport layer and further suppress occurrence of image deletion, polycarbonate resins (homopolymeric resins such as bisphenol A, bisphenol Z, bisphenol C, and bisphenol TP, and copolymer resins thereof) are preferable among the binder resins described above. The polycarbonate resins may be used alone or in combination of two or more. From the same reason, a bisphenol Z homopolymeric polycarbonate resin is preferred among the polycarbonate resins.

Properties of Charge Transport Layer

In this exemplary embodiment, the surface roughness Ra (arithmetic average surface roughness Ra) of a surface of the charge transport layer on which the inorganic protective layer is formed may be, for example, 2.1 nm or less or about 2.1 nm or less, 2.0 nm or less in some cases, or 1.8 nm or less in some cases. The lower limit is not particularly limited but may be 1 nm or more or may be 1.2 nm or more in some cases. As long as the surface roughness Ra is within these ranges, the decrease in cleaning property can be easily suppressed. Note that 1 nm is a measurement limit and it is difficult to measure a roughness smaller than 1 nm.

In this exemplary embodiment, since the surface roughness Ra (arithmetic average surface roughness Ra) of the surface of the charge transport layer on which the inorganic protective layer is formed is low, there is a limit to measuring the surface roughness with a probe-type surface roughness meter. Thus, in this exemplary embodiment, the surface roughness Ra is measured with an atomic force microscope (AFM).

Specifically, the inorganic protective layer is first separated to expose the surface to be measured. A part of that layer is cut out with a cutter, for example, to obtain a measurement sample. The measurement sample is analyzed and observed with an atomic force microscope (Nanopics 1000 produced by Seiko Instruments Inc.) under the conditions of measurement area: 400 $\mu m^2$, scan speed: 640. The arithmetic average surface roughness Ra in the four corners and a 25 $\mu m^2$ region at the center of the scan area is determined.

The elastic modulus of the charge transport layer may be, for example, 5 GPa or more, 6 GPa or more in some cases, 6.5 GPa or more in some cases, or 7 GPa or more in some cases. As long as the elastic modulus of the charge transport layer is within the above-described range, cracking of the inorganic protective layer is easily suppressed. The upper limit of the elastic modulus is not particularly limited and may be, for example, 20 GPa or less.

Examples of the method used to adjust the elastic modulus of the charge transport layer to be within the above described ranges include a method with which the diameter and amount of the silica particles are adjusted, a method with which the type and amount of the charge transport material are adjusted, and a method with which the type and amount of the silicone compound are adjusted.

The standard deviation of the elastic modulus of the charge transport layer may be 0.1 or more and 0.65 or less (or 0.2 or more and 0.62 or less in some cases or 0.2 or more and 0.60 or less in some cases) from the viewpoint of smoothly suppressing cracking of the inorganic protective layer.

The elastic modulus of the charge transport layer is measured as follows.

First, the inorganic protective layer is removed to expose the layer to be measured. A part of that layer is cut out with a cutter to obtain a measurement sample. The measurement sample is analyzed with Nano Indenter SA2 produced by MTS Systems Corporation by continuous stiffness measurement (CSM) (U.S. Pat. No. 4,848,141) to obtain a depth profile, and the average is calculated from the values observed at an indent depth of 30 nm to 100 nm.

The thickness of the charge transport layer is, for example, 10 μm or more and 40 μm or less, 10 μm or more and 35 μm or less in some cases, or 15 μm or more and 30 μm or less in some cases. When the thickness of the charge transport layer is within this range, cracking of the inorganic protective layer and generation of residual potential are easily suppressed.

Formation of Charge Transport Layer

A charge transport layer may be formed by any available forming method. For example, a coating solution for forming a charge transport layer is prepared by adding the above-described components to a solvent, a coating film is formed by using the coating solution, and the coating film is dried, and if desirable, heated to form a charge transport layer.

Examples of the technique for applying the coating solution for forming a charge transport layer to the charge generation layer include known techniques such as a dip coating technique, a lift coating technique, a wire bar coating technique, a spray coating technique, a blade coating technique, a knife coating technique, and a curtain coating technique.

When particles (for example, silica particles or fluorocarbon resin particles) are dispersed in the coating solution for forming a charge transport layer, a medium disperser such as a ball mill, a vibrating ball mill, an attritor, a sand mill, or a horizontal sand mill or a medium-less disperser such as an agitator, an ultrasonic disperser, a roll mill, or a high-pressure homogenizer is employed. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure.

Inorganic Protective Layer

Composition of Inorganic Protective Layer

The inorganic protective layer is a layer that contains an inorganic material.

Examples of the inorganic material include oxide, nitride, carbon inorganic materials, and silicon inorganic materials since they offer mechanical strength and a light-transmitting property sufficient for a protective layer.

Examples of the oxide inorganic materials include metal oxides such as gallium oxide, aluminum oxide, zinc oxide, titanium oxide, indium oxide, tin oxide, and boron oxide, and mixed crystals of the foregoing. Examples of the nitride inorganic materials include metal nitrides such as gallium nitride, aluminum nitride, zinc nitride, titanium nitride, indium nitride, tin nitride, and boron nitride, and mixed crystals of the foregoing. Examples of the carbon inorganic materials and silicon inorganic materials include diamond-like carbon (DLC), amorphous carbon (a-C), hydrogenated amorphous carbon (a-C:H), hydrogenated and fluorinated amorphous carbon (a-C:H:F), amorphous silicon carbide (a-SiC), hydrogenated amorphous silicon carbide (a-SiC:H), amorphous silicon (a-Si), and hydrogenated amorphous silicon (a-Si:H). The inorganic material may be mixed crystals of oxide and nitride inorganic materials.

Among these, metal oxides have excellent mechanical strength and light-transmitting property, and n-type conductivity, and excellent conductivity controllability. Thus, metal oxides, in particular, oxides of group 13 elements (in particular, gallium oxide) may be used to form the inorganic protective layer.

That is, the inorganic protective layer may contain at least a group 13 element (in particular, gallium) and oxygen, and optionally hydrogen. Incorporation of hydrogen facilitates control of various properties of the inorganic protective layer containing at least a group 13 element (in particular, gallium) and oxygen. For example, in an inorganic protective layer containing gallium, oxygen, and hydrogen (for example, an inorganic protective layer containing hydrogen-containing gallium oxide), changing the [O]/[Ga] compositional ratio from 1.0 to 1.5 facilitates controlling the volume resistivity within the range of $10^9$ Ω·cm or more and $10^{14}$ Ω·cm or less.

The sum of the constitutional ratios of the group 13 element, oxygen, and hydrogen relative to all elements constituting the inorganic surface layer may be 90 at. % or more. When the sum of the constitutional ratios of these elements is 90 at. % or more, a group 15 element, such as N, P, or As, that has been unintentionally mixed is inhibited from bonding to gallium, and thus it becomes easier to find an appropriate range of the oxygen-to-gallium compositional ratio (oxygen/gallium) that can improve hardness and electric properties of the inorganic surface layer.

The sum of the constitutional ratios of these elements may be 95 at. % or more, 96 at. % or more in some cases, and 97 at. % or more in some cases.

The oxygen-to-group 13 element compositional ratio (oxygen/group 13 element) may be 1.1 or more and 1.5 or less. When this compositional ratio (oxygen/group 13 element) is 1.1 or more, the hardness of the inorganic surface layer is maintained, mechanical damage is reduced, and the decrease in electrical resistance is suppressed. As a result, deletion of the electrostatic latent image in an in-plane direction is decreased and the image resolution can be easily obtained. When this ratio is 1.5 or less, the residual potential is suppressed. The oxygen-to-group 13 element compositional ratio (oxygen/group 13 element) may be 1.1 or more and 1.4 or less.

The inorganic protective layer may contain, in addition to the above-described inorganic materials, at least one element selected from C, Si, Ge, and Sn in order for the inorganic protective layer to be n-type. If the conductivity type is to be p-type, the inorganic protective layer may contain at least one element selected from N, Be, Mg, Ca, and Sr.

If the inorganic protective layer contains gallium, oxygen, and optionally hydrogen, the element constitutional ratio may be as follows from the viewpoint of obtaining excellent mechanical strength, light-transmitting property, flexibility, and conductivity controllability.

The ratio of gallium relative to all constitutional elements in the inorganic protective layer is, for example, preferably 15 at. % or more and 50 at. % or less, more preferably 20 at. % or more and 40 at. % or less, and most preferably 20 at. % or more and 30 at. % or less.

The ratio of oxygen relative to all constitutional elements in the inorganic protective layer is, for example, preferably 30 at. % or more and 70 at. % or less, more preferably 40 at. % or more and 60 at. % or less, and most preferably 45 at. % or more and 55 at. % or less.

The ratio of hydrogen relative to all constitutional elements in the inorganic protective layer is, for example, preferably 10 at. % or more and 40 at. % or less, more preferably 15 at. % or more and 35 at. % or less, and most preferably 20 at. % or more and 30 at. % or less.

The oxygen/gallium atomic ratio is preferably more than 1.50 but not more than 2.20 and more preferably 1.6 or more and 2.0 or less.

The element constitutional ratios of the respective elements constituting the inorganic protective layer, the atomic ratio, etc., are determined by Rutherford backscattering (hereinafter referred to as "RBS"). The distributions in the thickness direction are also determined by RBS.

In RBS, 3SDH PELLETRON produced by National Electrostatics Corporation (NEC) is used as an accelerator, RBS-400 (produced by CE&A Co., Ltd.) is used as an endstation, and 3S-R10 is used as a system. A HYPRA program produced by CE&A Co., Ltd., and the like are used in the analysis.

The RBS measurement conditions are as follows: He++ ion beam energy: 2.275 eV, detection angle: 160°, grazing angle relative to incident beam: about 109°.

RBS measurement is conducted as follows.

First, a He++ ion beam is applied perpendicular to the sample and a detector is positioned at an angle of 160° with respect to the ion beam to measure the signals of backscattered He. The energy and strength of the detected He determine the compositional ratio and the film thickness. The spectrum may be measured at two detection angles in order to improve accuracy of determining the compositional ratio and film thickness. Conducting measurement at two detection angles having different depth-direction resolution and backscattering dynamics and performing cross-checking improve accuracy.

The number of the He atoms backscattered by the target atoms is determined only from the three factors, namely, 1) the atomic number of the target atom, 2) energy of He atoms before scattering, and 3) scattering angle. The density is predicted from the detected composition through calculation and the thickness is determined by using the density. The margin of error in determining the density is within 20%.

The hydrogen ratio is determined by hydrogen forward scattering (hereinafter referred to as "HFS"). In HFS measurement, 3SDH PELLETRON produced by National Electrostatics Corporation (NEC) is used as an accelerator, RBS-400 produced by CE&A Co., Ltd., is used as an endstation, and 3S-R10 is used as a system. A HYPRA program produced by CE&A Co., Ltd., and the like are used in the analysis. The HFS measurement conditions are as follows:

He++ ion beam energy: 2.275 eV

Detection angle: grazing angle of 30° with respect to 160°

In the HFS measurement, the detector is positioned at 30° with respect to the He++ ion beam and the sample is positioned at 75° with respect to the normal line so as to pick up signals of hydrogen scattered forward out of the sample. During this process, the detector may be covered with an aluminum foil to remove the He atoms scattering with hydrogen. Quantitative determination is conducted by normalizing the hydrogen counts of the reference samples and the measured sample by a stopping power and then comparing the normalized counts. A sample formed of Si and H ion-implanted in Si and white mica are used as the reference samples. White mica is known to have a hydrogen concentration of 6.5 at. %. The hydrogen count is corrected by subtracting the number of H atoms adhering to the clean Si surface, for example, so as to count out H adhering to the outermost surface.

Properties of Inorganic Protective Layer

The inorganic protective layer may have a compositional ratio distribution in the thickness direction or may have a multilayer structure depending on the purpose.

The inorganic protective layer may be a non-single-crystal film such as a microcrystalline film, a polycrystalline film, or an amorphous film. An amorphous film is preferable since it has a smooth and flat surface and a microcrystalline is more preferable from the viewpoint of hardness.

A growth section of the inorganic protective layer may have a columnar structure. From the viewpoint of slidability, the growth section may have a highly flat structure and thus may be amorphous. Crystallinity and amorphousness are determined by the presence or absence of spots and lines in diffraction diagrams obtained by reflection high energy electron diffraction (RHEED) measurement.

The volume resistivity of the inorganic protective layer is, for example, $10^6$ Ω·cm or more and may be $10^8$ Ω·cm or more. When the volume resistivity is within this range, charges rarely flow in the surface direction and electrostatic latent images are formed smoothly.

The volume resistivity is determined by measuring the resistance values with LCR meter ZM2371 produced by NF Corporation at a frequency of 1 kHz and a voltage of 1 V and calculating the volume resistivity from the measured resistance value, the electrode area, and the sample thickness.

The measurement sample may be a sample prepared by forming a layer on an aluminum base under the same conditions as those for forming the inorganic protective layer to be measured and forming a gold electrode on the deposited layer by vacuum vapor deposition. Alternatively, the measurement sample may be a sample prepared by separating the inorganic protective layer from an already prepared electrophotographic photoreceptor, partly etching the separated inorganic protective layer, and sandwiching the etched inorganic protective layer between a pair of electrodes.

The elastic modulus of the inorganic protective layer is 30 GPa or more and 80 GPa or less and may be 40 GPa or more and 65 GPa or less. When the elastic modulus is within this range, generation of nicks (dents), cracking, and separation in the inorganic protective layer are likely to be suppressed.

The elastic modulus is determined by using NANO INDENTER SA2 produced by MTS Systems Corporation by continuous stiffness measurement (CSM) (U.S. Pat. No. 4,848,141) to obtain a depth profile, and calculating the average from the values observed at an indent depth of 30 nm to 100 nm. The measurement conditions are as follows:

Measurement environment: 23° C., 55% RH

Indenter used: regular triangle pyramid indenter made of diamond (Berkovich indenter)

Testing Mode: CSM Mode

The measurement sample may be a sample prepared by forming a film on a base under the same conditions as those for forming the inorganic protective layer to be measured, or may be a sample prepared by separating the inorganic protective layer from an already prepared electrophotographic photoreceptor and partially etching the separated inorganic protective layer.

The thickness of the inorganic protective layer is, for example, 0.2 μm or more and 10.0 μm or less or may be 0.4 μm or more and 5.0 μm or less. When the thickness is within this range, generation of nicks (dents), cracking, and separation of the inorganic protective layer are likely to be suppressed.

Formation of Inorganic Protective Layer

Examples of the technique used to form a protective layer include commonly employed vapor phase film-forming techniques such as a plasma chemical vapor deposition (CVD) technique, a metal organic chemical vapor deposition technique, a molecular beam epitaxy technique, vapor deposition, and sputtering.

Formation of an inorganic protective layer is described below as a specific example while describing an example of a film forming device through the drawings. Although the description below concerns the method for forming an inorganic protective layer that contains gallium, oxygen, and hydrogen, the method is not limited to this. Any common method may be employed depending on the intended composition of the inorganic protective layer.

Figure 4A:
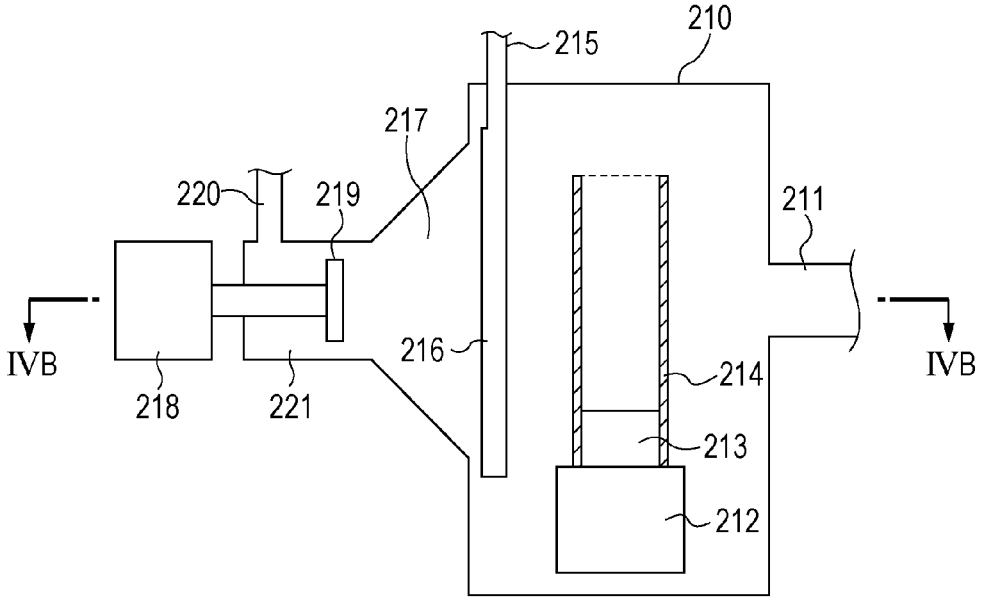
FIGS. 4A and 4B are schematic diagrams illustrating an example of a film forming device used to form an inorganic protective layer of the electrophotographic photoreceptor of the exemplary embodiment.
Figure 4B:
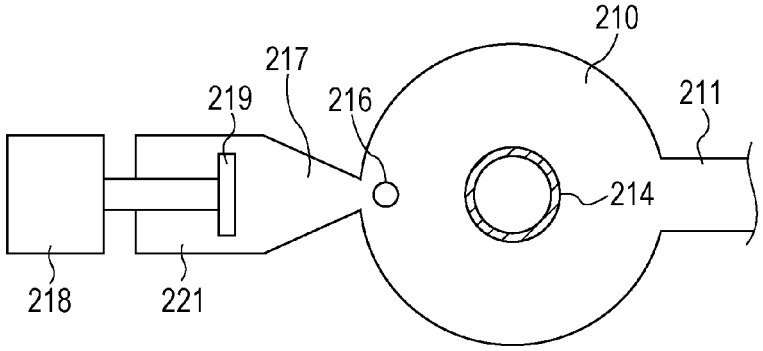

FIGS. 4A and 4B are each a schematic diagram of an example of a film forming device used in forming an inorganic protective layer of an electrophotographic photoreceptor according to the exemplary embodiment. FIG. 4A is a schematic cross-sectional view of the film forming device as viewed from a side, and FIG. 4B is a schematic cross-sectional view of the film forming device taken along line IVB-IVB in FIG. 4A. In FIGS. 4A and 4B, reference numeral 210 denotes a deposition chamber, 211 denotes an exhaust, 212 denotes a base rotating unit, 213 denotes a base supporting unit, 214 denotes a base, 215 denotes a gas inlet duct, 216 denotes a shower nozzle having an opening through which gas introduced from the gas inlet duct 215 is injected, 217 denotes a plasma diffusing unit, 218 denotes a high-frequency power supply unit, 219 denotes a plate electrode, 220 denotes a gas inlet duct, and 221 denotes a high-frequency discharge tube.

In the film forming device illustrated in FIGS. 4A and 4B, the exhaust 211 connected to a vacuum evacuator not illustrated in the drawing is provided at one end of the deposition chamber 210. A plasma generator that includes the high-frequency power supply unit 218, the plate electrode 219, and the high-frequency discharge tube 221 is provided to the deposition chamber 210 on the side opposite to where the exhaust 211 is installed.

This plasma generator is constituted by the high-frequency discharge tube 221, the plate electrode 219 installed within the high-frequency discharge tube 221 and having a discharge surface positioned on the exhaust 211 side, and the high-frequency power supply unit 218 disposed outside the high-frequency discharge tube 221 and connected to a surface of the plate electrode 219 opposite of the discharge surface. The gas inlet duct 220 through which gas is supplied to the interior of the high-frequency discharge tube 221 is connected to the high-frequency discharge tube 221, and the other end of the gas inlet duct 220 is connected to a first gas supply source not illustrated in the drawings.

Figure 5:
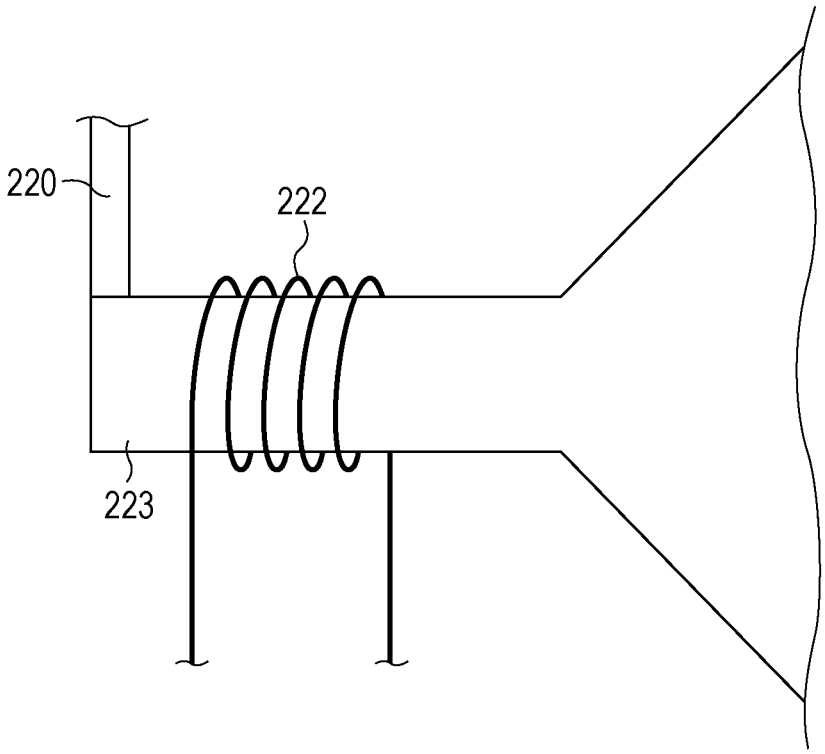
FIG. 5 is a schematic diagram illustrating an example of a plasma generator used to form the inorganic protective layer of the electrophotographic photoreceptor of the exemplary embodiment.

Instead of the plasma generator in the film forming device illustrated in FIGS. 4A and 4B, a plasma generator illustrated in FIG. 5 may be used. FIG. 5 is a schematic diagram illustrating another example of the plasma generator used in the film forming device illustrated in FIGS. 4A and 4B. FIG. 5 is a side view of the plasma generator. In FIG. 5, reference numeral 222 denotes a high-frequency coil, 223 denotes a quartz tube, and 220 is the same as the one illustrated in FIGS. 4A and 4B. The plasma generator includes the quartz tube 223 and the high-frequency coil 222 disposed along the outer peripheral surface of the quartz tube 223. One end of the quartz tube 223 is connected to the deposition chamber 210 (not illustrated in FIG. 5). The other end of the quartz tube 223 is connected to the gas inlet duct 220 through which gas is introduced to the interior of the quartz tube 223.

Referring to FIGS. 4A and 4B, the shower nozzle 216 having a rod shape and extending along the discharge surface of the plate electrode 219 is connected to the discharge surface side of the plate electrode 219, and one end of the shower nozzle 216 is connected to the gas inlet duct 215. The gas inlet duct 215 is connected to a second gas supply source (not illustrated in the drawings) disposed outside the deposition chamber 210. The base rotating unit 212 is installed in the deposition chamber 210. The base 214 has a cylindrical shape and may be loaded onto the base rotating unit 212 through the base supporting unit 213 so that the base 214 faces the shower nozzle 216 in such a manner that the longitudinal direction of the shower nozzle 216 coincides with the axial direction of the base 214. During film deposition, the base rotating unit 212 rotates so as to turn the base 214 in the circumferential direction. An example of the base 214 is a photoreceptor that includes layers up to an organic photosensitive layer formed in advance.

The inorganic protective layer is formed as follows, for example.

First, oxygen gas (or helium (He)-diluted oxygen gas), helium (He) gas, and optionally hydrogen ($H_2$) gas are introduced to the interior of the high-frequency discharge tube 221 through the gas inlet duct 220, and at the same time, a 13.56 MHz radio wave is supplied to the plate electrode 219 from the high-frequency power supply unit 218. During this process, the plasma diffusing unit 217 that spreads radially from the discharge surface side of the plate electrode 219 toward the exhaust 211 is formed. The gas introduced from the gas inlet duct 220 flows in the deposition chamber 210 from the plate electrode 219 side toward the exhaust 211 side. The plate electrode 219 may be surrounded by an earth shield.

Next, trimethyl gallium gas is introduced into the deposition chamber 210 through the gas inlet duct 215 and the shower nozzle 216 located downstream of the plate electrode 219, which serves as an activating unit, so as to form a non-single-crystal film containing gallium, oxygen, and hydrogen on the surface of the base 214. For example, a base on which an organic photosensitive layer is formed is used as the base 214.

The temperature of the surface of the base 214 during deposition of the inorganic protective layer is 150° C. or lower, preferably 100° C. or lower, and more preferably 30° C. to 100° C. since an organic photoreceptor having an organic photosensitive layer is used.

Even if the temperature of the surface of the base 214 is 150° C. or lower at the beginning of the deposition, the temperature may become higher than 150° C. due to the effect of the plasma. In such a case, the organic photosensitive layer may be damaged by heat. Thus, the surface temperature of the base 214 is to be controlled by taking into account this effect.

The temperature of the surface of the base 214 may be controlled by using a heating device and a cooling device (not illustrated in the drawings), for example, or may be left to naturally increase as a result of discharge. In the case where the base 214 is heated, a heater may be installed on the outer side or inner side of the base 214. In the case where the base 214 is cooled, gas or liquid for cooling may be provided to circulate on the inner side of the base 214.

If the increase in the temperature of the surface of the base 214 by discharge is to be avoided, the increase may be effectively avoided by adjusting the high-energy gas flow applied to the surface of the base 214. In such a case, the conditions such as gas flow rate, discharge output, and pressure are adjusted so that the intended temperature is obtained.

Instead of trimethyl gallium gas, an organic metal compound containing aluminum or a hydride such as diborane may be used. Two or more of these may be used as a mixture. For example, in the initial stage of forming an inorganic protective layer, trimethyl indium may be introduced into the deposition chamber 210 through the gas inlet duct 215 and the shower nozzle 216 so as to form a film containing nitrogen and indium on the base 214. In such a case, this film absorbs ultraviolet rays that are generated during the subsequent film deposition and that deteriorate the organic photosensitive layer. As a result, damage onto the organic photosensitive layer inflicted by generation of ultraviolet rays during film deposition is suppressed.

In order to perform doping with a dopant during film deposition, $SiH_3$ or $SnH_4$ in a gas state is used for n-type doping, and biscyclopentadienylmagnesium, dimethyl calcium, dimethyl strontium, or the like in a gas state is used for p-type doping. In order to dope the surface layer with dopant atoms, a commonly used technique, such as a thermal diffusion technique or an ion implantation technique, may be employed. Specifically, for example, gas containing at least one dopant atoms is introduced into the deposition chamber 210 through the gas inlet duct 215 and the shower nozzle 216 so as to obtain an inorganic protective layer having a particular conductivity type such as n-type or p-type.

In the film forming device illustrated in FIGS. 4A, 4B, and 5, active nitrogen or active hydrogen formed by discharge energy may be independently controlled by providing plural activating devices. Alternatively, gas simultaneously containing nitrogen atoms and hydrogen atoms, such as $NH_3$ may be used. Yet alternatively, $H_2$ may be added. Conditions that generate free active hydrogen from the organic metal compound may be employed.

As a result, activated carbon atoms, gallium atoms, nitrogen atoms, hydrogen atoms, and the like are present on the surface of the base 214 in a controlled manner. The activated hydrogen atoms have an effect of inducing desorption of hydrogen atoms in a molecular form from hydrocarbon groups such as methyl and ethyl groups constituting the organic metal compound. Accordingly, a hard film (inorganic protective layer) constituting three-dimensional bonds is formed.

The plasma generator of the film forming device illustrated in FIGS. 4A, 4B, and 5 uses a high-frequency oscillator; however, the plasma generator is not limited to this. For example, a microwave oscillator, an electrocyclotron resonance plasma source, or a helicon plasma source may be used. The high-frequency oscillator may be of an induction type or a capacitance type. Two or more of these devices of different types may be used in combination, or two or more devices of the same type may be used in combination. A high-frequency oscillator may be used to suppress the increase in temperature of the surface of the base 214. Alternatively, a device that suppresses heat radiation may be provided.

In the case where two or more plasma generators of different types are used, adjustment may be made so that discharge is induced simultaneously at the same pressure. There may be a difference in pressure between the region where discharge is conducted and the region where deposition is conducted (region where the base is loaded). These devices may be arranged in series relative to the gas flow that flows from the portion where the gas is introduced to the portion where the gas is discharged in the film forming device. Alternatively, the devices may be arranged so that all of the devices face the deposition surface of the base.

For example, when two types of plasma generators (plasma generating units) are arranged in series relative to the gas flow in a film forming device illustrated in FIGS. 4A and 4B, the shower nozzle 216 serves as an electrode and is used as a second plasma generator that induces discharge in the deposition chamber 210. In such a case, for example, a high-frequency voltage is applied to the shower nozzle 216 through the gas inlet duct 215 so that discharge occurs in the deposition chamber 210 by using the shower nozzle 216 as an electrode. Alternatively, instead of using the shower nozzle 216 as an electrode, a cylindrical electrode is provided between the base 214 and the plate electrode 219 in the deposition chamber 210 and the cylindrical electrode is used to induce discharge in the deposition chamber 210. In the case where two different types of plasma generators are used at the same pressure, for example, when a microwave oscillator and a high-frequency oscillator are used, the excitation energies of the excitation species are markedly changed, which is effective for controlling the quality of the film. Discharge may be conducted at about an atmospheric pressure (70,000 Pa or more and 110,000 Pa or less). Helium (He) may be used as carrier gas in conducting discharge at about atmospheric pressure.

The inorganic protective layer is formed by, for example, placing a base 214, on which an organic photosensitive layer is formed, in the deposition chamber 210 and introducing mixed gas of different compositions to form an inorganic protective layer.

In the case where high-frequency discharge is to be conducted, for example, the frequency may be adjusted to be in the range of 10 kHz or more and 50 MHz or less in order to form a high-quality film at low temperature. The output depends on the size of the base 214 and may be in the range of 0.01 $W/cm^2$ or more and 0.2 $W/cm^2$ or less relative to the surface area of the base. The rotation speed of the base 214 may be in the range of 0.1 rpm or more and 500 rpm or less.

In the description above, an example of an electrophotographic photoreceptor in which the organic photosensitive layer is of a separated function type and the charge transport layer is of a single layer type is described. In the case of the electrophotographic photoreceptor illustrated in FIG. 2 (the organic photosensitive layer is of a separated function type and the charge transport layer is of a multilayer type), the charge transport layer 3A in contact with the inorganic protective layer 5 may have the same structure as the charge transport layer 3 of the electrophotographic photoreceptor illustrated in FIG. 1 and the charge transport layer 3B not in contact with the inorganic protective layer 5 may have the same structure as a typical charge transport layer. The thickness of the charge transport layer 3A may be 1 μm or more and 15 μm or less. The thickness of the charge transport layer 3B may be 15 μm or more and 29 μm or less.

In the case of the electrophotographic photoreceptor illustrated in FIG. 3 (example in which the organic photosensitive layer is of a single layer type), the single-layer-type organic photosensitive layer 6 (charge generation/charge transport layer) may have the same structure as the charge transport layer 3 of the electrophotographic photoreceptor except for incorporation of the charge generation material. The amount of the charge generation material in the single-layer-type organic photosensitive layer 6 may be 25% by weight or more and 50% by weight or less relative to the entire single-layer-type organic photosensitive layer. The thickness of the single-layer-type organic photosensitive layer 6 may be 15 μm or more and 30 μm or less.

Image Forming Apparatus (and Process Cartridge)

An image forming apparatus according to an exemplary embodiment includes an electrophotographic photoreceptor, a charging unit that charges a surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor with a developer containing a toner so as to form a toner image, and a transfer unit that transfers the toner image onto a surface of a recording medium. The electrophotographic photoreceptor of the aforementioned exemplary embodiment is used as the electrophotographic photoreceptor.

The image forming apparatus of this exemplary embodiment is applicable to commonly used image forming apparatuses such as follows: an apparatus equipped with a fixing unit that fixes the toner image transferred onto the surface of the recording medium; a direct-transfer-type apparatus that directly transfers the toner image formed on the surface of the electrophotographic photoreceptor onto the recording medium; an intermediate-transfer-type apparatus that transfers the toner image formed on the surface of the electrophotographic photoreceptor onto a surface of an intermediate transfer body (first transfer) and then transfers the toner image on the surface of the intermediate transfer body onto a surface of the recording medium (second transfer); an apparatus equipped with a cleaning unit that cleans the surface of the electrophotographic photoreceptor after the transfer of the toner image and before charging; an apparatus equipped with a charge erasing unit that applies charge erasing light onto the surface of the electrophotographic photoreceptor after the transfer of the toner image and before charging; and an apparatus equipped with a member that heats the electrophotographic photoreceptor in order to increase the temperature of the electrophotographic photoreceptor and decrease the relative temperature.

According to the intermediate-transfer-type apparatus, the transfer unit includes an intermediate transfer body having a surface onto which a toner image is transferred, a first transfer unit that transfers the toner image on the surface of the electrophotographic photoreceptor onto a surface of the intermediate transfer body, and a second transfer unit that transfers the toner image on the surface of the intermediate transfer body onto a surface of a recording medium.

The image forming apparatus of this exemplary embodiment may be a dry-development type image forming apparatus or a wet-development type image forming apparatus (development is conducted by using a liquid developer).

In the image forming apparatus of this exemplary embodiment, for example, the portion equipped with an electrophotographic photoreceptor may have a cartridge structure (process cartridge) detachably attachable to the image forming apparatus. An example of the process cartridge is a process cartridge that includes the electrophotographic photoreceptor of the exemplary embodiment. The process cartridge may include, in addition to the electrophotographic photoreceptor, at least one selected from the group consisting of a charging unit, an electrostatic latent image forming unit, a developing unit, and a transfer unit.

A non-limiting example of the image forming apparatus of the exemplary embodiment is described below. The components illustrated in the drawings are described, and the descriptions of other components not illustrated in the drawings are omitted.

Figure 6:
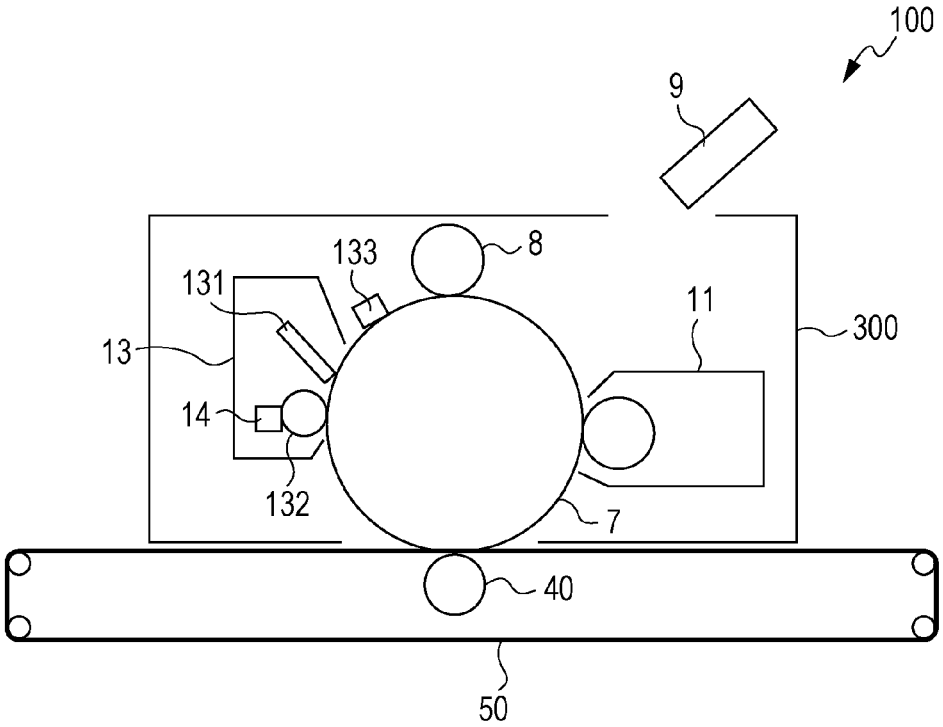
FIG. 6 is a schematic diagram illustrating an example of an image forming apparatus according to an exemplary embodiment.

FIG. 6 is a schematic diagram illustrating an example of the image forming apparatus of the exemplary embodiment. Referring to FIG. 6, an image forming apparatus 100 of the exemplary embodiment includes a process cartridge 300 that includes an electrophotographic photoreceptor 7, an exposing device 9 (an example of an electrostatic latent image forming unit), a transfer device 40 (first transfer device), and an intermediate transfer body 50. In the image forming apparatus 100, the exposing device 9 is located at a position such that the exposing device 9 applies light to the electrophotographic photoreceptor 7 through an opening in the process cartridge 300. The transfer device 40 is located at a position such that the transfer device 40 opposes the electrophotographic photoreceptor 7 with the intermediate transfer body 50 therebetween. The intermediate transfer body 50 is arranged so that a part of the intermediate transfer member 50 contacts the electrophotographic photoreceptor 7. Although not illustrated in the drawing, a second transfer device that transfers the toner image on the intermediate transfer body 50 onto a recording medium (for example, paper sheet) is also provided. The intermediate transfer body 50, the transfer device 40 (first transfer device), and the second transfer device (not illustrated in the drawing) correspond to examples of the transfer unit.

The process cartridge 300 illustrated in FIG. 6 integrally supports the electrophotographic photoreceptor 7, a charging device 8 (an example of a charging unit), a developing device 11 (an example of a developing unit), and a cleaning device 13 (an example of a cleaning unit) in the housing. The cleaning device 13 includes a cleaning blade (an example of a cleaning member) 131, and the cleaning blade 131 is arranged to make contact with a surface of the electrophotographic photoreceptor 7. The cleaning member may be a conductive or insulating fibrous member instead of the cleaning blade 131. The conductive or insulating fibrous member may be used alone or in combination with the cleaning blade 131.

FIG. 6 illustrates an example of the image forming apparatus that includes a fibrous member 132 (roll shape) that supplies a lubricant 14 onto the surface of the electrophotographic photoreceptor 7, and a fibrous member 133 (flat brush shape) that assists cleaning. These parts are arranged as needed.

Individual components of the image forming apparatus of the exemplary embodiment will now be described.

Charging Device

Examples of the charging device 8 include contact-type chargers that use conductive or semi-conductive charging rollers, charging brushes, charging films, charging rubber blades, and charging tubes; and non-contact-type chargers known in the art such as non-contact-type roller chargers and scorotron chargers and corotron chargers that use corona discharge.

Exposing Device

An example of the exposing device 9 is an optical device that illuminates the surface of the electrophotographic photoreceptor 7 by light from a semiconductor laser, an LED, or a liquid crystal shutter so as to form an intended light image on the surface. The wavelength of the light source is to be within the region of the spectral sensitivity of the electrophotographic photoreceptor. The mainstream semiconductor lasers are infrared lasers having an oscillation wavelength around 780 nm. The wavelength is not limited to this, and a laser that has an oscillation wavelength on the order of 600 nm or a blue laser that has an oscillation wavelength of 400 nm or more and 450 nm or less may also be used. A surface-emission type laser light source capable of outputting a multibeam is effective for forming color images.

Developing Device

An example of the developing device 11 is a typical developing device that conducts development by using a developer in a contact or non-contact manner. The developing device 11 may be any device that has this function and is selected according to the purpose. An example thereof is a known developing device that has a function of causing a one-component or two-component developer to attach to the electrophotographic photoreceptor 7 by using a brush, a roller, or the like. In particular, the developing device may use a development roller that retains the developer on the surface thereof.

The developer used in the developing device 11 may be a one-component developer formed of a toner alone or may be a two-component developer formed of a toner and a carrier. The developer may be magnetic or non-magnetic. Known developers may be used as the developer.

Cleaning Device

A cleaning blade-type device equipped with the cleaning blade 131 is used as the cleaning device 13. A fur brush cleaning technique or a technique of performing development and cleaning simultaneously may be employed instead of or in addition to the cleaning blade.

Transfer Device

Examples of the transfer device 40 include contact-type transfer chargers that use belts, rollers, films, rubber blades, etc., and scorotron transfer chargers and corotron transfer chargers that use corona discharge known in the art.

Intermediate Transfer Body

The intermediate transfer body 50 may be a belt-shaped member (intermediate transfer belt) that contains a polyimide, a polyamideimide, a polycarbonate, a polyarylate, a polyester, rubber, or the like that is made semi-conductive. The intermediate transfer body may have a drum shape instead of the belt shape.

Figure 7:
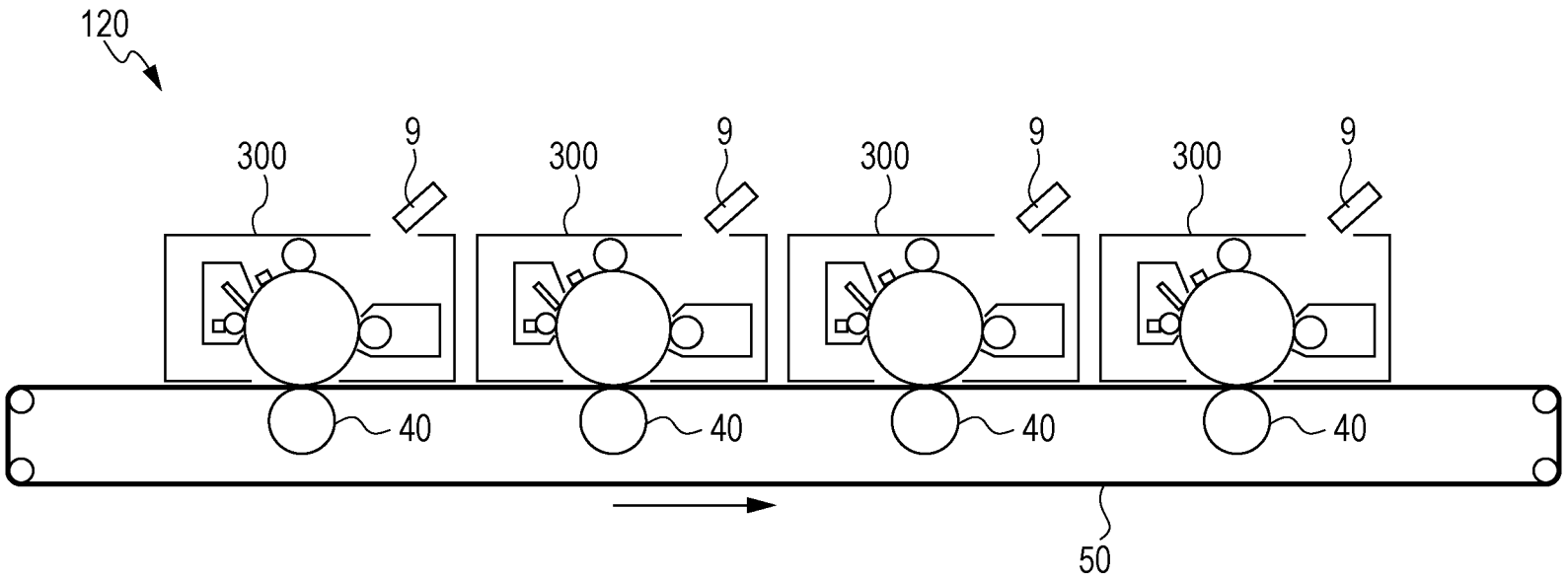
FIG. 7 is a schematic diagram illustrating another example of an image forming apparatus according to the exemplary embodiment.

FIG. 7 is a schematic diagram illustrating another example of the image forming apparatus of the exemplary embodiment. An image forming apparatus 120 illustrated in FIG. 7 is a multi-color image forming apparatus of a tandem-type equipped with four process cartridges 300. In the image forming apparatus 120, four process cartridges 300 are arranged side-by-side on the intermediate transfer body 50. One electrophotographic photoreceptor is used for one color. The image forming apparatus 120 has the same structure as the image forming apparatus 100 except for that the image forming apparatus 120 is of a tandem type.

The structure of the image forming apparatus 100 is not limited to one described above. For example, a first charge erasing device that makes the polarity of the residual toner uniform so that the residual toner may be easily removed may be provided around the electrophotographic photoreceptor 7, on the downstream side of the transfer device 40 in the electrophotographic photoreceptor 7 rotation direction and on the upstream side of the cleaning device 13 in the electrophotographic photoreceptor rotating direction. Alternatively, a second charge erasing device that erases charges from the surface of the electrophotographic photoreceptor 7 may be provided on the downstream side of the cleaning device 13 in the electrophotographic photoreceptor rotating direction and on the upstream side of the charging device 8 in the electrophotographic photoreceptor rotating direction.

The structure of the image forming apparatus 100 is not limited to one described above and may be, for example, any known direct-transfer-type image forming apparatus that directly transfers a toner image on the electrophotographic photoreceptor 7 onto a recording medium.

EXAMPLES

The present invention will now be specifically described by way of examples which do not limit the scope of the present invention. In the examples below, "parts" means parts by weight.

Preparation and Manufacture of Silica Particles

Silica Particles (1)

To 100 parts by weight of untreated (hydrophilic) silica particles whose trade name is OX40SH (produced by AEROSIL CO., LTD.), 30 parts by weight of hexamethyldisilazane (1,1,1,3,3,3-hexamethyldisilazane produced by Tokyo Chemical Industry Co., Ltd.) is added, and the reaction is carried out for 24 hours. Then hydrophobized silica particles are obtained by filtering the resulting reaction product, and assumed to be silica particles (1). The condensation ratio of the silica particles (1) is 99%.

Example 1

Manufacture of Undercoat Layer

Zinc oxide (average particle diameter: 70 nm, produced by Tayca Corporation, specific surface area: 15 $m^2/g$) in an amount of 100 parts by weight is mixed and stirred with 500 parts by weight of tetrahydrofuran, and 1.3 parts by weight of a silane coupling agent (KBM503 produced by Shin-Etsu Chemical Co., Ltd.) is added to the resulting mixture, followed by stirring for 2 hours. Then tetrahydrofuran is distilled away at a reduced pressure, and baking is conducted at 120° C. for 3 hours. As a result, zinc oxide surface-treated with a silane coupling agent is obtained.

The surface-treated zinc oxide in an amount of 110 parts by weight is mixed and stirred with 500 parts by weight of tetrahydrofuran. A solution prepared by dissolving 0.6 part by weight of alizarin in 50 parts by weight of tetrahydrofuran is added to the resulting mixture, followed by stirring at 50° C. for 5 hours. The alizarin-added zinc oxide is filtered out by vacuum filtration and dried at 60° C. at a reduced pressure. As a result, alizarin-added zinc oxide is obtained.

A solution is prepared by dissolving 60 parts by weight of the alizarin-added zinc oxide, 13.5 parts by weight of a curing agent (blocked isocyanate, SUMIDUR 3175 produced by Sumitomo Bayer Urethane Co., Ltd.), and 15 parts by weight of butyral resin (S-LEC BM-1 produced by Sekisui Chemical Co., Ltd.) in 85 parts by weight of methyl ethyl ketone, and 38 parts by weight of this solution is mixed with 25 parts by weight of methyl ethyl ketone. The resulting mixture is dispersed for 2 hours in a sand mill using glass beads 1 mm in diameter to obtain a dispersion.

To the dispersion, 0.005 part by weight of dioctyltin dilaurate and 40 parts by weight of silicone resin particles (TOSPEARL 145 produced by Momentive Performance Materials Inc.) are added to obtain a coating solution for forming an undercoat layer. The coating solution is applied to an aluminum base having a diameter of 60 mm, a length of 357 mm, and a thickness of 1 mm by a dip coating technique and cured by drying at 170° C. for 40 minutes. As a result, an undercoat layer having a thickness of 19 μm is obtained.

Manufacture of Charge Generation Layer

A mixture containing 15 parts by weight of hydroxygallium phthalocyanine serving as a charge generation material and at least having diffraction peaks at Bragg angles (2θ±0.2°) of 7.3°, 16.0°, 24.9°, and 28.0° in an X-ray diffraction spectrum taken with a Cu Kα characteristic X-ray, 10 parts by weight of a vinyl chloride-vinyl acetate copolymer (VMCH produced by Nippon Unicar Company Limited) serving as a binder resin, and 200 parts by weight of n-butyl acetate is dispersed for 4 hours in a sand mill with glass beads having a diameter of 1 mm. To the resulting dispersion, 175 parts by weight of n-butyl acetate and 180 parts by weight of methyl ethyl ketone are added, followed by stirring. As a result, a coating solution for forming a charge generation layer is obtained. The coating solution for forming a charge generation layer is applied to the undercoat layer by dip coating, and dried at room temperature (25° C.). As a result, a charge generation layer having a thickness of 0.2 μm is obtained.

Manufacture of Charge Transport Layer

To 50 parts by weight of the silica particles (1), 250 parts by weight of tetrahydrofuran is added. While maintaining the temperature of the resulting mixture to 20° C., 25 parts by weight of 4-(2,2-diphenylethyl)-4',4"-dimethyl-triphenylamine and 25 parts by weight of bisphenol Z-type polycarbonate resin (viscosity-average molecular weight: 30,000) serving as a binder resin are added, and a silicone compound (1) (KP340, dimethylsilicone oil produced by Shin-Etsu Chemical Co., Ltd.) is added so that the amount thereof is 0.0066% by weight relative to the solid content of the charge transport layer. The resulting mixture is mixed under stirring for 12 hours. As a result, a coating solution for forming a charge transport layer is obtained.

The coating solution for forming a charge transport layer is applied to the charge generation layer and dried at 150° C. for 40 minutes to form a charge transport layer having a thickness of 30 μm. Thus, an electrophotographic photoreceptor is obtained.

Through the steps described above, an organic photoreceptor (1) including an aluminum base, and an undercoat layer, a charge generation layer, and a charge transport layer stacked in that order on the aluminum base is obtained.

Formation of Inorganic Protective Layer

Next, an inorganic protective layer containing hydrogen-containing gallium oxide is formed on a surface of the organic photoreceptor (1). The inorganic protective layer is formed by using a film forming device having a structure illustrated in FIGS. 4A and 4B.

First, the organic photoreceptor (1) is placed on the base supporting unit 213 in the deposition chamber 210, and the deposition chamber 210 is vacuum-evacuated through the exhaust 211 until the pressure is 0.1 Pa. The vacuum evacuation is conducted within 5 minutes after completion of substitution of the gas containing oxygen at high concentration.

Next, 40% oxygen gas diluted with He (flow rate: 1.6 sccm) and hydrogen gas (flow rate: 50 sccm) are introduced from the gas inlet duct 220 into the high-frequency discharge tube 221 equipped with the plate electrode 219 having a diameter of 85 mm. The high-frequency power supply unit 218 and a matching circuit (not illustrated in FIGS. 4A and 4B) are used to set the output of the 13.56 MHz radio wave to 150 W, and discharge is conducted from the plate electrode 219 while conducting matching with a tuner. The returning wave is 0 W.

Next, trimethylgallium gas (flow rate: 1.9 sccm) is introduced from the shower nozzle 216 to the plasma diffusing unit 217 in the deposition chamber 210 through the gas inlet duct 215. The reaction pressure inside the deposition chamber 210 measured by a BARATRON vacuum meter is 5.3 Pa.

Under such conditions, while the organic photoreceptor (1) is rotated at a rate of 500 rpm, a film is formed for 68 minutes. As a result, an inorganic protective layer having a thickness of 1.5 μm is formed on the surface of the charge transport layer of the organic photoreceptor (1).

Through the steps described above, an electrophotographic photoreceptor of Example 1 in which an undercoat layer, a charge generation layer, a charge transport layer, and an inorganic protective layer are sequentially stacked on a conductive substrate is obtained.

Examples 2 to 9 and Comparative Examples 1 to 4

Electrophotographic photoreceptors of Examples 2 to 9 and Comparative Examples 1 to 4 are obtained as in Example 1 except that the type of the binder resin, the amount of silica particles, and the type and amount of the silicone compound used in the charge transport layer are changed as described in Table. The quantity of the silica particles in percent by weight indicated in Table is relative to the entire charge transport layer assumed to be 100. In Example 9, a silicone compound (2) (KF54, methylphenyl-silicone oil produced by Shin-Etsu Chemical Co., Ltd.) is used.

Evaluation

AFM Surface Roughness Ra

For each of the electrophotographic photoreceptors of the examples, the AFM surface roughness Ra of the surface of the charge transport layer on which the inorganic protective layer is to be formed is measured by a procedure already described.

Elastic Modulus

Elastic modulus of the electrophotographic photoreceptor of each example is measured by the procedure described above.

Cracking (Denting)

The electrophotographic photoreceptor obtained in each example is loaded onto 700 DIGITAL COLOR PRESS produced by Fuji Xerox Co. Ltd. A halftone image (image density: 30%) is output continuously on 100 sheets in a 20° C. 40% RH environment. The surface of the electrophotographic photoreceptor (surface of the inorganic protective layer) is observed with a laser microscope at a magnification of 450 in 10 view areas. The number of nicks that are dented portions is counted, and the number of dents per unit area (1 mm×1 mm) is calculated.

The evaluation standards are as follows:

A: The number of dents is 20 or less.

B: The number of dents is more than 20 but not more than 100.

C: The number of dents is more than 100.

Cleaning Property

The electrophotographic photoreceptor obtained in each example is loaded onto 700 DIGITAL COLOR PRESS produced by Fuji Xerox Co. Ltd. A print test that involves outputting a halftone image (image density: 30%) continuously until 100 kPV (=100,000 sheets) in a 20° C. 40% RH environment is conducted to evaluate the cleaning property.

Evaluation Standards

A: Compared to initially output images, an image of the same quality is output after continuous output.

B: Compared to initially output images, 50% or less of the image region after continuous output has undergone a decrease in image density.

C: Compared to initially output images, the image density of the entire image region is decreased after continuous output.

Residual Potential

An exposure beam (beam source: semiconductor laser, wavelength: 780 nm, output: 5 mW) is applied to a surface of an electrophotographic photoreceptor rotating at 167 rpm while being charged to −700 V by a scorotron charger so as to scan the surface. Then the potential of the electrophotographic photoreceptor is measured with a surface potentiometer (model 344, produced by TREK JAPAN KK) to investigate the state of potential (residual potential) of the electrophotographic photoreceptor. This is repeated for 100 cycles and the residual potential at the 100th cycle is measured.

Evaluation Standards

A: Residual potential (RP) is 100 V or less.

B: Residual potential (RP) is more than 100 V but not more than 150 V.

C: Residual potential (RP) is more than 150 V.

"PCZ" indicates a bisphenol Z homopolymeric polycarbonate resin (TS2030 with Mv 30000 produced by Teijin Limited and TS2050 with Mv 50000 produced by Teijin Limited).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an organic photosensitive layer on the conductive substrate; and an inorganic protective layer on the organic photosensitive layer, wherein a layer that constitutes a surface of the organic photosensitive layer contains a charge transport material, a binder resin, silica particles, and a silicone compound, and wherein the silica particles are contained in an amount in the range of about 30% by weight to about 70% by weight relative to the entirety of the layer that constitutes the surface of the organic photosensitive layer.

2. The electrophotographic photoreceptor according to claim 1, wherein the organic photosensitive layer includes:

TABLE

| | Charge transport layer | | | | | | | | Evaluation | | |
|---|---|---|---|---|---|---|---|---|---|---|---|
| | Silica particles | Silicone compound | | Binder resin | | AFM | Elastic modulus | | | | |
| | % by weight | Type | % by weight | Type | Mv | roughness (nm) | (GPa) | Standard deviation | Cracking (denting) | Cleaning property | Residual potential |
| Example 1 | 50 | (1) | 0.0066 | PCZ | 30000 | 1.7 | 7.5 | 0.49 | A | A | A |
| Example 2 | 50 | (1) | 0.0033 | PCZ | 30000 | 1.8 | 7.3 | 0.55 | A | B | A |
| Example 3 | 50 | (1) | 0.033 | PCZ | 30000 | 1.7 | 7.5 | 0.50 | A | B | B |
| Example 4 | 50 | (1) | 0.0026 | PCZ | 30000 | 1.8 | 7.2 | 0.58 | A | B | A |
| Example 5 | 50 | (1) | 0.04 | PCZ | 30000 | 1.7 | 7.5 | 0.56 | A | A | B |
| Example 6 | 75 | (1) | 0.0066 | PCZ | 30000 | 2.0 | 11.2 | 0.60 | A | B | A |
| Example 7 | 25 | (1) | 0.0066 | PCZ | 30000 | 1.4 | 7.1 | 0.40 | A | A | A |
| Example 8 | 50 | (1) | 0.0066 | PCZ | 50000 | 1.8 | 7.8 | 0.55 | A | A | A |
| Example 9 | 50 | (2) | 0.0066 | PCZ | 30000 | 1.8 | 7.6 | 0.51 | A | A | A |
| Comparative Example 1 | 50 | — | — | PCZ | 30000 | 1.9 | 7.0 | 0.70 | B | B | A |
| Comparative Example 2 | 50 | — | — | PCZ | 50000 | 2.4 | 7.4 | 0.76 | B | C | A |
| Comparative Example 3 | — | — | — | PCZ | 30000 | 1.0 | 3.0 | 0.32 | C | B | A |
| Comparative Example 4 | — | (1) | 0.0066 | PCZ | 30000 | 0.8 | 3.0 | 0.28 | C | B | A |

The results illustrate that Examples have better evaluation results regarding cracking compared to Comparative Examples.

Abbreviations used in Table are as follows.

"Mv" in the binder resin column indicates a viscosity-average molecular weight.

a charge generation layer; and a charge transport layer that contains the charge transport material, the binder resin, the silica particles, and the silicone compound, wherein the charge transport layer is on the charge generation layer.

3. The electrophotographic photoreceptor according to claim 1, wherein an amount of the silicone compound relative to a solid content of the layer that constitutes the surface of the organic photosensitive layer is in the range of about 0.0033% by weight to about 0.033% by weight.

4. The electrophotographic photoreceptor according to claim 1, wherein the silicone compound is a silicone oil.

5. The electrophotographic photoreceptor according to claim 1, wherein a surface of the organic photosensitive layer on which the inorganic protective layer is formed has a surface roughness Ra of about 2.1 nm or less.

6. The electrophotographic photoreceptor according to claim 1, wherein the silica particles are hydrophobized and have a condensation ratio of about 96% or more.

7. The electrophotographic photoreceptor according to claim 1, wherein a weight ratio of an amount of the silica particles to an amount of the silicone compound (silica particles:silicone compound) is in the range of about 1000:1 to about 20000:1.

8. A process cartridge detachably attachable to an image forming apparatus, comprising the electrophotographic photoreceptor according to claim 1.

9. An image forming apparatus comprising:

the electrophotographic photoreceptor according to claim 1;

a charging unit that charges a surface of the electrophotographic photoreceptor;

an electrostatic latent image forming unit that forms an electrostatic latent image on the charged surface of the electrophotographic photoreceptor;

a developing unit that develops the electrostatic latent image on the surface of the electrophotographic photoreceptor with a developer containing a toner so as to form a toner image; and a transfer unit that transfers the toner image onto a surface of a recording medium.

* * * * *